US008839885B2

(12) United States Patent
Shuman, V et al.

(10) Patent No.: US 8,839,885 B2
(45) Date of Patent: Sep. 23, 2014

(54) LATCHING CONFIGURATION FOR A MICROTUNNELING APPARATUS

(75) Inventors: Robert Hoch Shuman, V, Pleasant Hill, IA (US); Douglas Eugene See, Jr., Grinnell, IA (US); Stuart Harrison, Clyde (AU); Jeffrey James Utter, Prairie City, IA (US); Matthew Arlen Mills, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 626 days.

(21) Appl. No.: 13/081,080

(22) Filed: Apr. 6, 2011

(65) Prior Publication Data

US 2011/0266062 A1 Nov. 3, 2011

Related U.S. Application Data

(60) Provisional application No. 61/324,175, filed on Apr. 14, 2010.

(51) Int. Cl.

| | |
|---|---|
| ***E21B 17/046*** | (2006.01) |
| ***E21B 7/28*** | (2006.01) |
| ***E21B 17/04*** | (2006.01) |
| ***E21B 21/12*** | (2006.01) |
| ***E21B 19/083*** | (2006.01) |
| ***E21D 9/00*** | (2006.01) |
| ***E21B 7/04*** | (2006.01) |
| ***E21B 7/20*** | (2006.01) |
| ***E21B 47/022*** | (2012.01) |
| ***E21B 7/06*** | (2006.01) |
| *E21B 17/18* | (2006.01) |

(52) U.S. Cl.

CPC . *E21B 7/28* (2013.01); *E21B 17/04* (2013.01); *E21B 21/12* (2013.01); *E21B 19/083* (2013.01); *E21D 9/004* (2013.01); *E21B 7/046* (2013.01); *E21B 7/20* (2013.01); *E21B 47/022* (2013.01); *E21B 7/062* (2013.01); *E21B 17/18* (2013.01); *E21B 17/046* (2013.01)

USPC ..... 175/320

(58) Field of Classification Search

USPC ..... 175/320

See application file for complete search history.

(56) References Cited

U.S. PATENT DOCUMENTS 4,281,725 A * 8/1981 Runk ..... 175/246
6,408,952 B1 6/2002 Brand et al.

(Continued)

FOREIGN PATENT DOCUMENTS

WO WO 2007/143773 12/2007

OTHER PUBLICATIONS

International Search Report and Written Opinion mailed Apr. 25, 2011.

*Primary Examiner* — David Bagnell
*Assistant Examiner* — Michael Goodwin
(74) *Attorney, Agent, or Firm* — Merchant & Gould P.C.

(57) ABSTRACT

A drill rod is disclosed. The drill rod includes a casing assembly defining a length that extends axially between a first end and an opposite second end of the drill rod, and a drive shaft rotatably mounted within the casing assembly. The drive shaft extends axially along the drill rod generally from the first end of the casing assembly to the second end of the casing assembly. The drill rod also includes latching pins at the first end of the drill rod and latching pin receivers at the second end of the drill rod. The drill rod further includes latches provided adjacent the latching pin receivers. The latches are movable between latching and non-latching positions. The latches move along an orientation of movement then the latches between the latching and non-latching positions. The drill rod may also include biasing structures that apply retention forces to the latches for retaining the latches in the non-latching position. The retention forces have at least components that extend in directions perpendicular to the orientation of movement of the latches. The drill rod may further include cam arms for moving the latches into a latching position and for retaining the latches in a latching position.

18 Claims, 17 Drawing Sheets

(56) References Cited

U.S. PATENT DOCUMENTS

| | | | | |
|---|---|---|---|---|
| 7,374,375 | B2 * | 5/2008 | Kleine et al. | 408/226 |
| 2006/0279078 | A1 * | 12/2006 | Johnson et al. | 285/27 |
| 2008/0099248 | A1 | 5/2008 | Davies | |
| 2009/0146011 | A1 * | 6/2009 | Ritter et al. | 244/172.4 |
| 2009/0152012 | A1 | 6/2009 | Salins et al. | |
| 2010/0206637 | A1 * | 8/2010 | Harrison et al. | 175/76 |

* cited by examiner

LATCHING CONFIGURATION FOR A MICROTUNNELING APPARATUS

This application claims priority to U.S. Provisional Patent Application Ser. No. 61/324,175, filed Apr. 14, 2010 and said application is incorporated herein by reference in its entirety.

TECHNICAL FIELD

The present disclosure relates generally to trenchless drilling equipment. More particularly, the present disclosure relates to tunneling (e.g., drilling, backreaming, etc.) equipment capable of maintaining a precise grade and line.

BACKGROUND

Modern installation techniques provide for the underground installation of services required for community infrastructure. Sewage, water, electricity, gas and telecommunication services are increasingly being placed underground for improved safety and to create more visually pleasing surroundings that are not cluttered with visible services.

One method for installing underground services involves excavating an open trench. However, this process is time consuming and is not practical in areas supporting existing construction. Other methods for installing underground services involve boring a horizontal underground hole. However, most underground drilling operations are relatively inaccurate and unsuitable for applications on grade and on line.

PCT International Publication No. WO 2007/143773 discloses a micro-tunneling system and apparatus capable of boring and reaming an underground micro-tunnel at precise grade and line. While this system represents a significant advance over most prior art systems, further enhancements can be utilized to achieve even better performance.

SUMMARY

The present disclosure relates to latching structures and methods for latching together pipe sections of a drill string.

One aspect is a drill rod comprising a casing assembly defining a length that extends axially between a first end and an opposite second end of the drill rod, the casing assembly defining a first passage that extends axially along the drill rod from the first end of the casing assembly to the second end of the casing assembly, the casing assembly also defining a second passage that extends axially along the drill rod from the first end of the casing assembly to the second end of the casing assembly. In addition the drill rod also includes a drive shaft rotatably mounted within the casing assembly, the drive shaft extending axially along the drill rod generally from the first end of the casing assembly to the second end of the casing assembly, the drive shaft having a center axis that is offset from axes of the first and second passages, the axes of the first and second passages also being offset from one another. The casing assembly further includes first and second endplates positioned respectively at the first and second ends of the casing assembly, the first and second end plates supporting the drive shaft, the first and second end plates also defining first openings that align with the first passage and second openings that align with the second passage. The casing assembly also includes an outer shell that defines an outer boundary of the drill rod and that extends from the first end plate to the second end plate. The drill rod further includes alignment pins that project outwardly from the first end plate and alignment pin receivers defined by the second end plate.

The drill rod still further includes latches provided adjacent the alignment pin receivers for latching alignment pins of an adjacent drill rod within the alignment pin receivers, the latches being movable between latching and non-latching positions, the latches moving in a plane that is generally transverse relative to the center axis of the drive shaft when the latches move between the latching and non-latching positions. Moreover, the drill rod includes biasing structures that apply retention forces to the latches for retaining the latches in the non-latching position, the retention forces having at least components that extend along the center axis of the drive shaft.

Another aspect is a pipe section comprising a casing assembly defining a length that extends axially between a first end and an opposite second end of the pipe section. The pipe section also includes latching pins at the first end of the pipe section and latching pin receivers at the second end of the pipe section. The pipe section further includes latches provided adjacent the latching pin receivers, the latches being movable between latching and non-latching positions, the latches moving along an orientation of movement when the latches move between the latching and non-latching positions. In addition the pipe section includes biasing structures that apply retention forces to the latches for retaining the latches in the non-latching position, the retention forces having at least components that extend in directions perpendicular to the orientation of movement of the latches.

A further aspect is a pipe section comprising a casing assembly defining a length that extends axially between a first end and an opposite second end of the pipe section. The pipe section also includes latching pins at the first end of the pipe section and latching pin receivers at the second end of the pipe section. The pipe section further includes latches provided adjacent the latching pin receivers, the latches being movable between latching and non-latching positions, the latches moving along an orientation of movement when the latches move between the latching and non-latching positions. In addition the pipe section includes cam arms that apply retention forces to the latches for retaining the latches in the latching position.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

A. Overview of Example Drilling Apparatus

Figure 1:
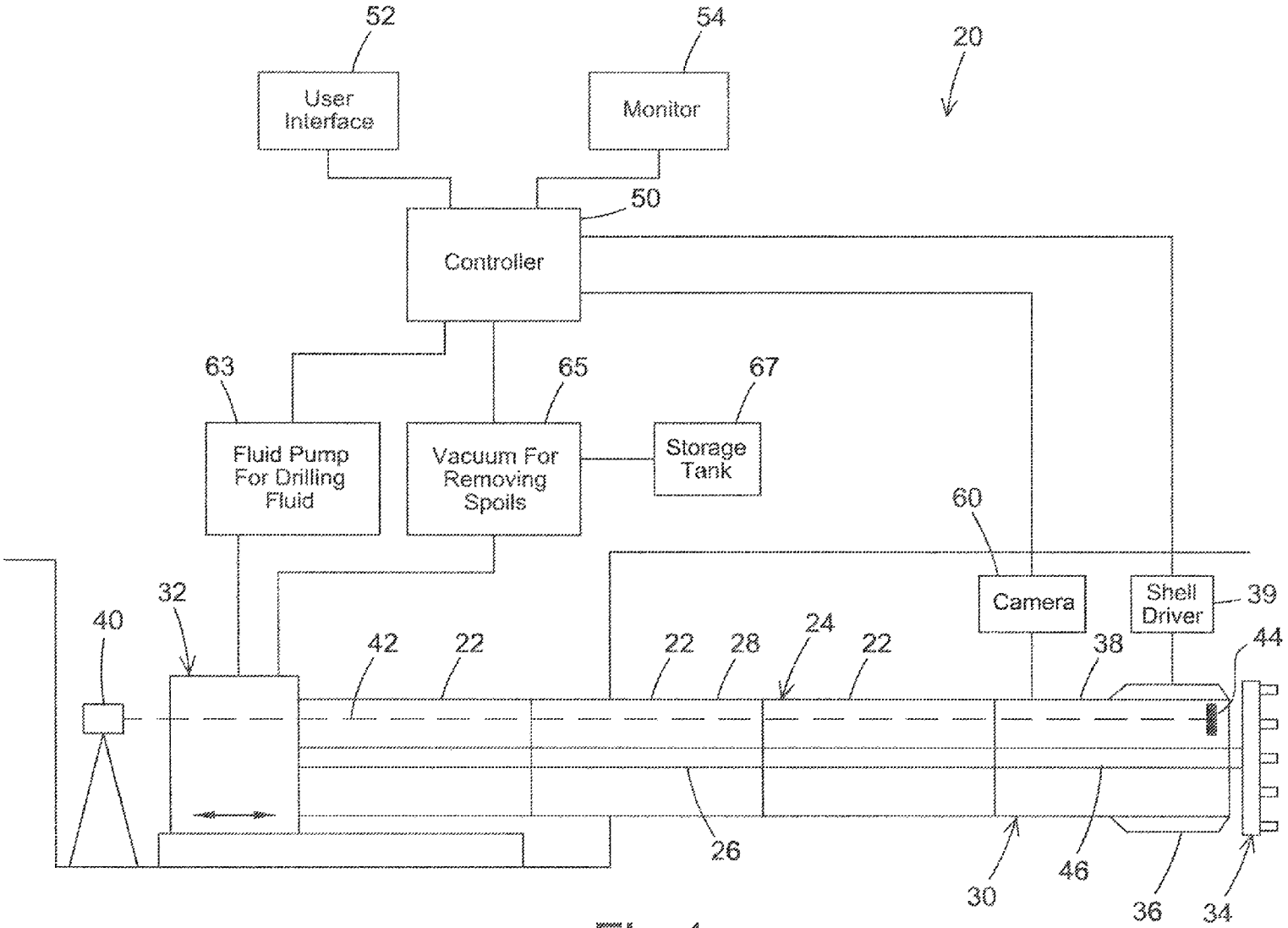
FIG. 1 is a schematic depiction of a tunneling apparatus having features in accordance with the principles of the present disclosure.

FIG. 1 shows a tunneling apparatus 20 having features in accordance with the principles of the present disclosure. Generally, the apparatus 20 includes a plurality of pipe sections 22 that are latched together in an end-to-end relationship to form a drill string 24. Each of the pipe sections 22 includes a drive shaft 26 rotatably mounted in an outer casing assembly 28. A drill head 30 is mounted at a distal end of the drill string 24 while a drive unit 32 is located at a proximal end of the drill string 24. The drive unit 32 includes a torque driver adapted to apply torque to the drill string 24 and an axial driver for applying thrust or pull-back force to the drill string 24. Thrust or pull-back force from the drive unit 32 is transferred between the proximal end and the distal end of the drill string 24 by the outer casing assemblies 28 of the pipe sections 22. Torque is transferred from the proximal end of the drill string 24 to the distal end of the drill string 24 by the drive shafts 26 of the pipe sections 22 which rotate relative to the casing assemblies 28. The torque from the drive unit 32 is transferred through the apparatus 20 by the drive shafts 26 and ultimately is used to rotate a cutting unit 34 of the drill head 30.

The pipe sections 22 can also be referred to as drill rods, drill stems or drill members. The pipe sections are typically used to form an underground bore, and then are removed from the underground bore when product (e.g., piping) is installed in the bore.

The drill head 30 of the drilling apparatus 20 can include a drive stem 46 rotatably mounted within a main body 38 of the drill head 30. The main body 38 can include a one piece body, or can include multiple pieces or modules coupled together. A distal end of the drive stem 46 is configured to transfer torque to the cutting unit 34. A proximal end of the drive stem 46 couples to the drive shaft 26 of the distal-most pipe section 22 such that torque is transferred from the drive shafts 26 to the drive stem 46. In this way, the drive stem 46 functions as the last leg for transferring torque from the drive unit 32 to the cutting unit 34. The outer casing assemblies 28 transfer thrust and/or pull back force to the main body 38 of the drill head. The drill head 30 preferably includes bearings (e.g., axial/thrust bearings and radial bearings) that allow the drive stem 46 to rotate relative to the main body 38 and also allow thrust or pull-back force to be transferred from the main body 38 through the drive stem 46 to the cutting unit 34.

In certain embodiments, the tunneling apparatus 20 is used to form underground bores at precise grades. For example, the tunneling apparatus 20 can be used in the installation of underground pipe installed at a precise grade. In some embodiments, the tunneling apparatus 20 can be used to install underground pipe or other product having an outer diameter less than 600 mm or less than 300 mm.

It is preferred for the tunneling apparatus 20 to include a steering arrangement adapted for maintaining the bore being drilled by the tunneling apparatus 20 at a precise grade and line. For example, referring to FIG. 1, the drill head 30 includes a steering shell 36 mounted over the main body 38 of the drill head 30. Steering of the tunneling apparatus 20 is accomplished by generating radial movement between the steering shell 36 and the main body 38 (e.g., with radially oriented pistons, one or more bladders, mechanical linkages, screw drives, etc.). Radial steering forces for steering the drill head 30 are transferred between the shell 36 and the main body 38. From the main body 38, the radial steering forces are transferred through the drive stem 46 to the cutting unit 34.

Steering of the tunneling apparatus 20 is preferably conducted in combination with a guidance system used to ensure the drill string 24 proceeds along a precise grade and line. For example, as shown at FIG. 1, the guidance system includes a laser 40 that directs a laser beam 42 through a continuous axially extending air passage (e.g., passage 43 shown at FIG. 14) defined by the outer casing assemblies 28 of the pipe sections 22 to a target 44 located adjacent the drill head 30. The air passage extends from the proximal end to the distal end of the drill string 24 and allows air to be provided to the cutting unit 34.

The tunneling apparatus 20 also includes an electronic controller 50 (e.g., a computer or other processing device) linked to a user interface 52 and a monitor 54. The user interface 52 can include a keyboard, joystick, mouse or other interface device. The controller 50 can also interface with a camera 60 such as a video camera that is used as part of the steering system. For example, the camera 60 can generate images of the location where the laser hits the target 44. It will be appreciated that the camera 60 can be mounted within the drill head 30 or can be mounted outside the tunneling apparatus 20 (e.g., adjacent the laser). If the camera 60 is mounted at the drill head 30, data cable can be run from the camera through a passage that runs from the distal end to the proximal end of the drill string 24 and is defined by the outer casing assemblies 28 of the pipe sections 22. In still other embodiments, the tunneling apparatus 20 may include wireless technology that allows the controller to remotely communicate with the down-hole camera 60.

During steering of the tunneling apparatus 20, the operator can view the camera-generated image showing the location of the laser beam 42 on the target 44 via the monitor 54. Based on where the laser beam 42 hits the target 44, the operator can determine which direction to steer the apparatus to maintain a desired line and grade established by the laser beam 42. The operator steers the drill string 24 by using the user interface 52 to cause a shell driver 39 to modify the relative radial position of the steering shell 36 and the main body 38 of the drill head 30. In one embodiment, a radial steering force/load is applied to the steering shell 36 in the radial direction opposite to the radial direction in which it is desired to turn the drill string 24.

For example, if it is desired to steer the drill string 24 upwardly, a downward force can be applied to the steering shell 36 which forces the main body 38 and the cutting unit 34 upwardly causing the drill string to turn upwardly as the drill string 24 is thrust axially in a forward/distal direction. Similarly, if it is desired to steer downwardly, an upward force can be applied to the steering shell 36 which forces the main body 38 and the cutting unit 34 downwardly causing the drill string 24 to be steered downwardly as the drill string 24 is thrust axially in a forward/distal direction.

In certain embodiments, the radial steering forces can be applied to the steering shell 36 by a plurality of radial pistons that are selectively radially extended and radially retracted relative to a center longitudinal axis of the drill string through operation of a hydraulic pump and/or valving. The hydraulic pump and/or valving are controlled by the controller 50 based on input from the user interface 52. In one embodiment, the hydraulic pump and/or the valving are located outside the hole being bored and hydraulic fluid lines are routed from pump/valving to the radial pistons via a passage that runs from the distal end to the proximal end of the drill string 24 and is defined within the outer casing assemblies 28 of the pipe sections 22. In other embodiments, the hydraulic pump and/or valving can be located within the drill head 30 and control lines can be routed from the controller 50 to the hydraulic pump and/or valving through a passage that runs from the distal end to the proximal end of the drill string 24 and is defined within the outer casing assemblies 28 of the pipe sections 22. In still other embodiments, the tunneling apparatus 20 may include wireless technology that allows the controller to remotely control the hydraulic pump and/or valving within the drill head 30.

To assist in drilling, the tunneling apparatus 20 can also include a fluid pump 63 for forcing drilling fluid from the proximal end to the distal end of the drill string 24. In certain embodiments, the drilling fluid can be pumped through a central passage (e.g., passage 45 shown at FIG. 14) defined through the drive shafts 26. The central passage defined through the drive shafts 26 can be in fluid communication with a plurality of fluid delivery ports provided at the cutting unit 34 such that the drilling fluid is readily provided at a cutting face of the cutting unit 34. Fluid can be provided to the central passage though a fluid swivel located at the drive unit 32.

The tunneling apparatus 20 can also include a vacuum system for removing spoils and drilling fluid from the bore being drilled. For example, the drill string 24 can include a vacuum passage (e.g., passage 47 shown at FIG. 14) that extends continuously from the proximal end to the distal end of the drill string 24. The proximal end of the vacuum passage can be in fluid communication with a vacuum 65 and the distal end of the vacuum passage is typically directly behind the cutting unit 34 adjacent the bottom of the bore. The vacuum 65 applies vacuum pressure to the vacuum passage to remove spoils and liquid (e.g., drilling fluid from fluid passage 45) from the bore being drilled. At least some air provided to the distal end of the drill string 24 through the air passage 43 (shown in FIG. 14) is also typically drawn into the vacuum passage to assist in preventing plugging of the vacuum passage. In certain embodiments, the liquid and spoils removed from the bore though the vacuum passage can be delivered to a storage tank 67.

Figure 14:
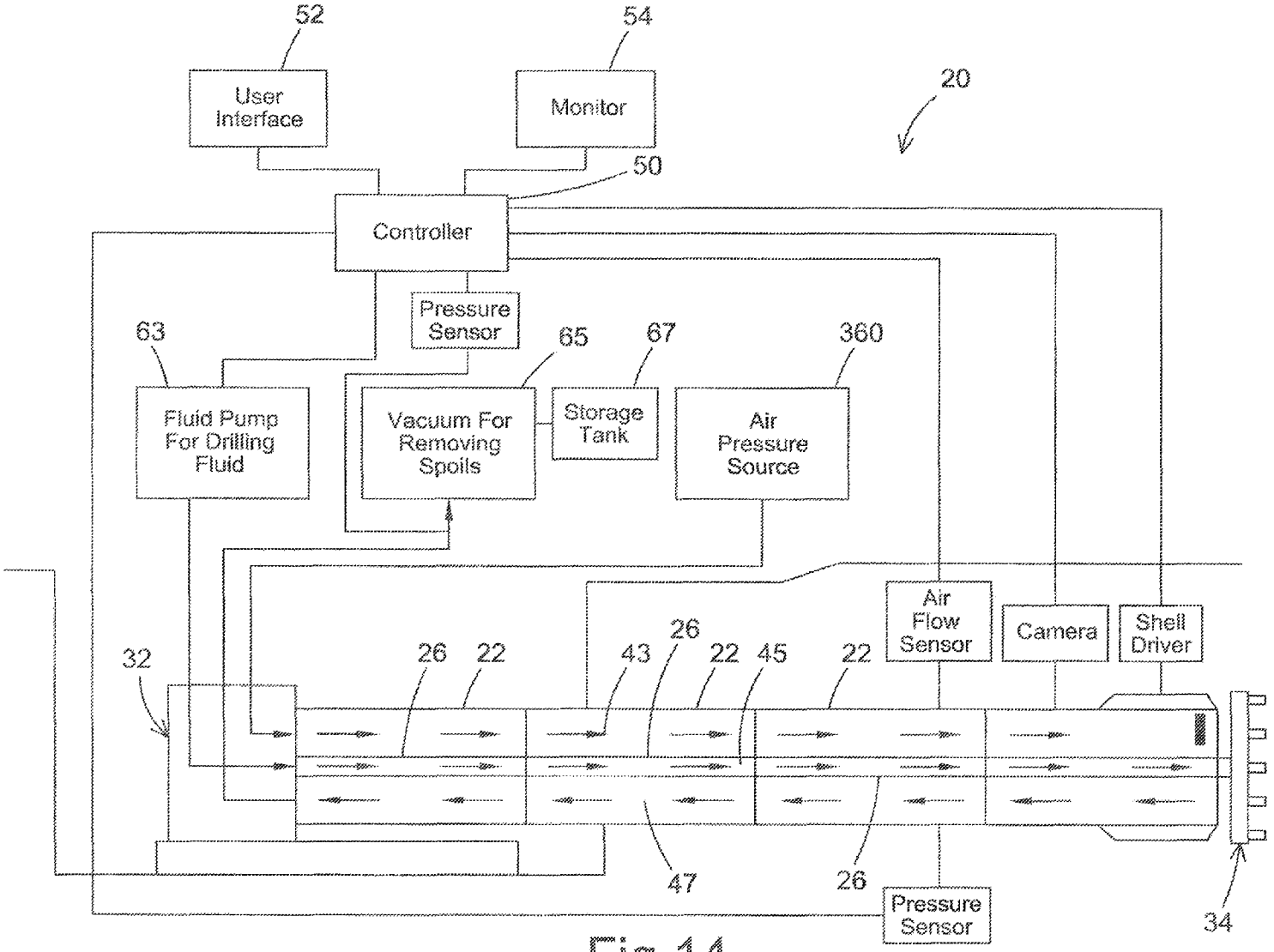
FIG. 14 is another schematic depiction of the tunneling apparatus of FIG. 1.

FIG. 14 is another schematic view of the tunneling apparatus 20 of FIG. 1. Referring to FIG. 14, the air and vacuum passages 43, 47 that extend axially through the drill string 24 are schematically depicted. The drive shafts 26 that extend axially through the drill string from the drive unit 32 to the cutting unit 34 are also schematically depicted. The fluid/liquid pump 63 is shown directing drilling fluid through the central fluid passageway 45 that is defined by the drive shafts 26 and that extends from the proximal end to the distal end of the drill string 24. In other embodiments, the fluid/liquid pump 63 can convey the drilling fluid down a fluid line positioned within the channel defined by the open-sided passage sections 130 (e.g. shown in FIG. 3) of the pipe sections 22. The air passage 43 is shown in fluid communication with an air pressure source 360 that directs compressed air into the proximal end of the air passage 43. The air pressure source 360 can include a fan, blower, air compressor, air pressure accumulator or other source of compressed air. The vacuum passage 47 is shown in fluid communication with the vacuum 65 for removing spoils from the bore. The vacuum 65 applies vacuum to the proximal end of the vacuum passage 47.

B. Example Pipe Section

FIGS. 2-11 show an example of one of the pipe sections 22 in accordance with the principles of the present disclosure. The pipe section 22 is elongated along a central axis 120 and includes a male end 122 (see FIG. 2) positioned opposite from a female end 124 (see FIG. 3). When a plurality of the pipe sections 22 are strung together, the female ends 124 are coupled to the male ends 122 of adjacent pipe sections 22.

Figure 2:
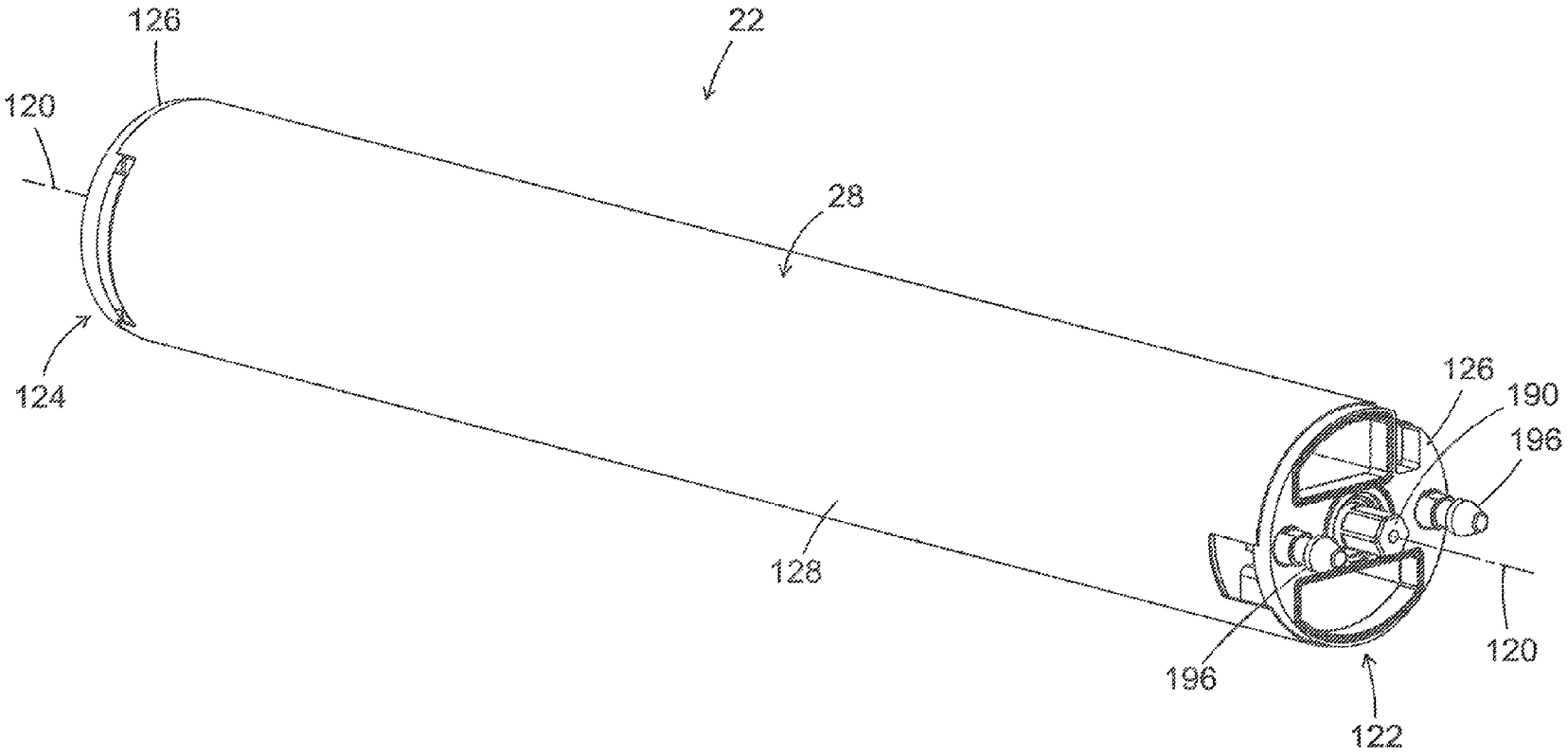
FIG. 2 is a perspective view showing a male end of a pipe section suitable for use with the tunneling apparatus schematically depicted at FIG. 1.
Figure 3:
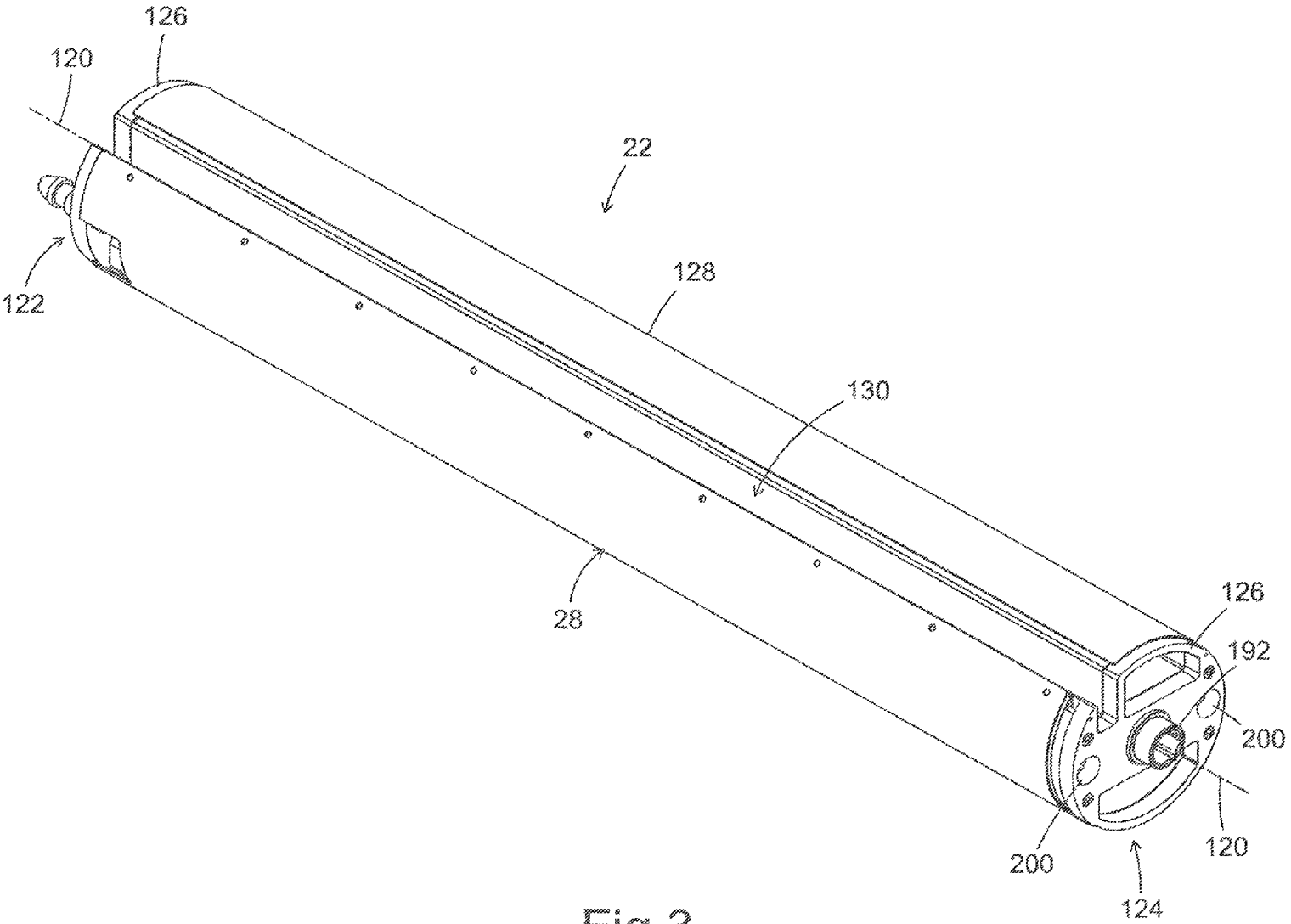
FIG. 3 is a perspective view showing a female end of the pipe section of FIG. 2.

Referring to FIGS. 2 and 3, the outer casing assembly 28 of the depicted pipe section 22 includes end plates 126 positioned at the male and female ends 122, 124. The outer casing assembly 28 also includes an outer shell 128 that extends from the male end 122 to the female end 124. The outer shell 128 is generally cylindrical and defines an outer diameter of the pipe section 22. In a preferred embodiment, the outer shell 128 is configured to provide support to a bore being drilled to prevent the bore from collapsing during the drilling process.

As shown at FIG. 3, the outer casing assembly 28 also defines an open-sided passage section 130 having a length that extends from the male end 122 to the female end 124 of the pipe section 22. The open-sided passage section 130 is defined by a channel structure 132 (see FIG. 11) having outer portions 134 secured (e.g., welded) to the outer shell 128. The channel structure 132 defines an open side 136 positioned at the outer shell 128. The open side 136 faces generally radially outwardly from the outer shell 128 and extends along the entire length of the pipe section 22. When the pipe sections 22 are coupled together to form the drill string 24, the open-sided passage sections 130 co-axially align with one another and cooperate to define a continuous open-sided exterior channel that extends along the length of the drill string 24.

Figure 4:
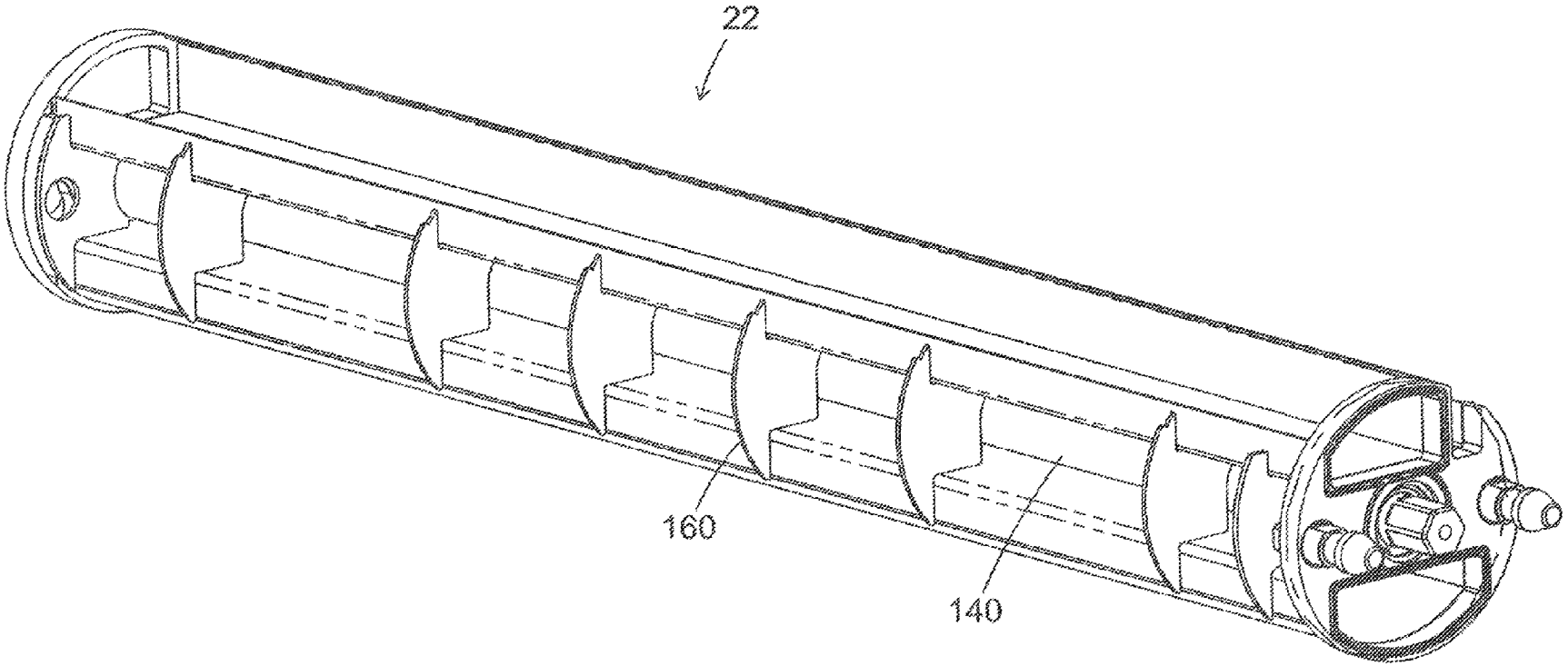
FIG. 4 is a perspective view of the pipe section of FIG. 2 with an outer shell removed to show internal components of the pipe section.
Figure 5:
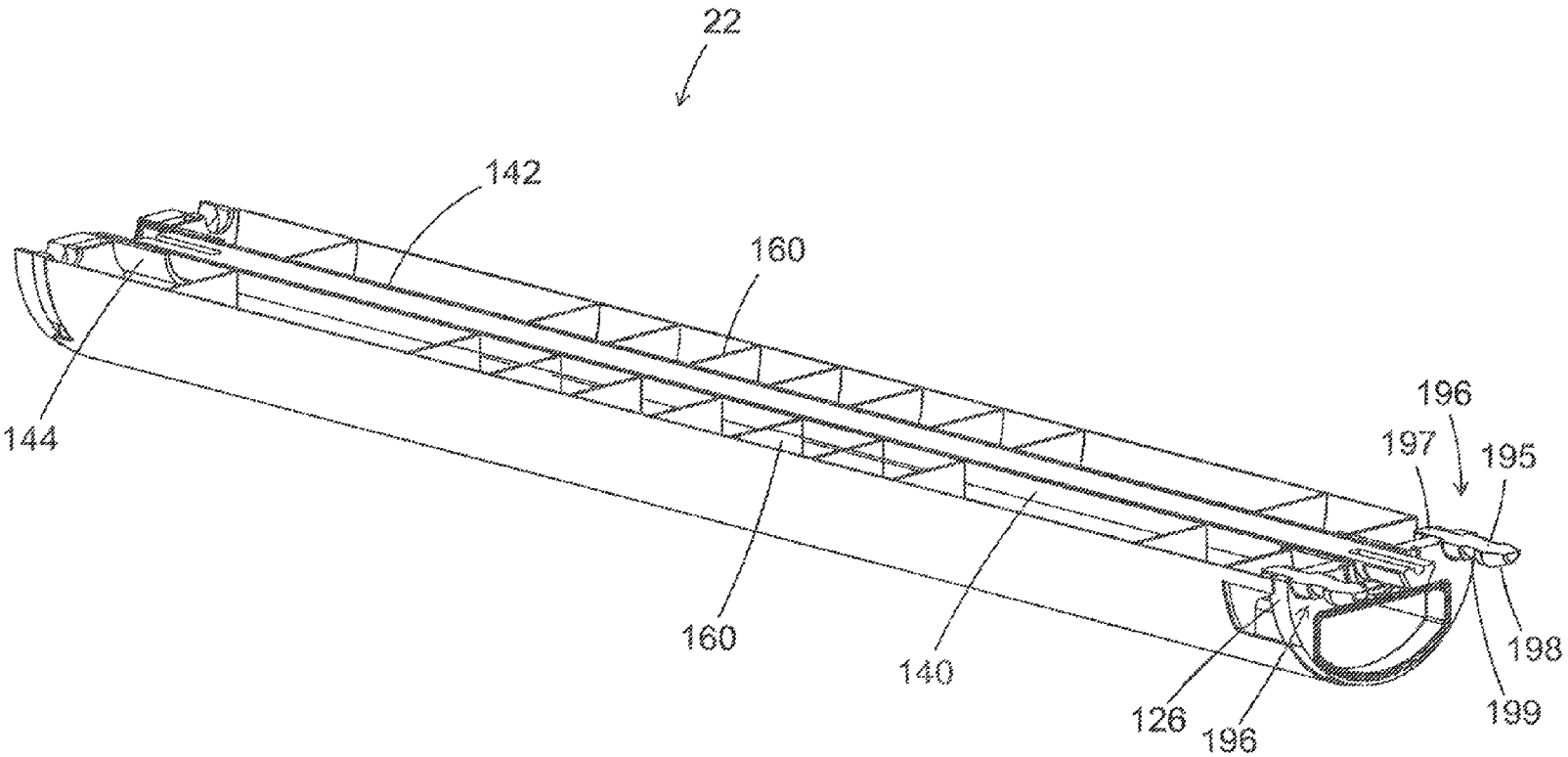
FIG. 5 is a perspective cross-sectional view of the pipe section of FIG. 2 with the pipe section being cut along a horizontal cross-sectional plane that bisects the pipe section.
Figure 6:
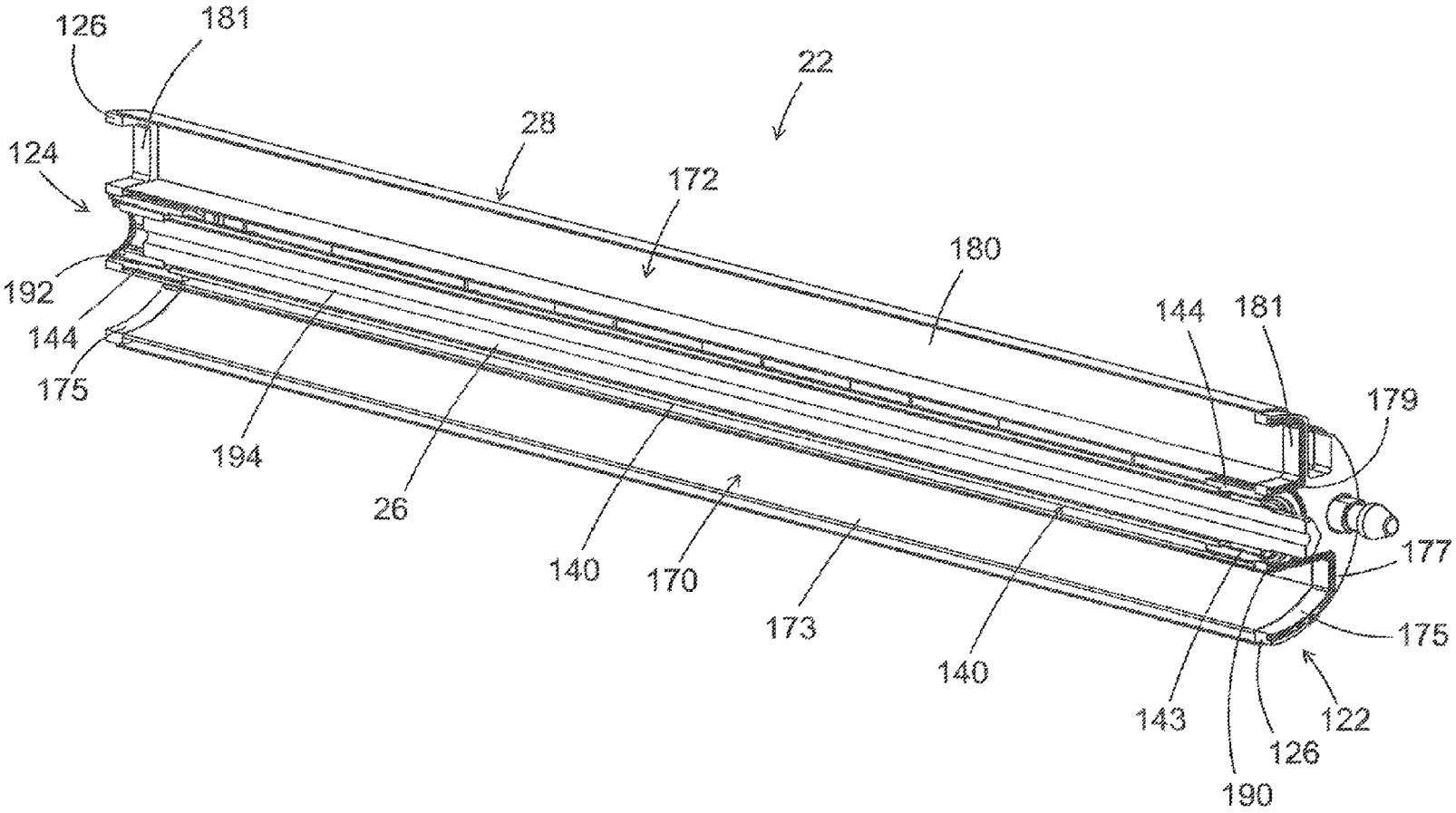
FIG. 6 is a perspective cross-sectional view of the pipe section of FIG. 2 with the pipe section being cut along a vertical cross-sectional plane that bisects the pipe section.
Figure 7:
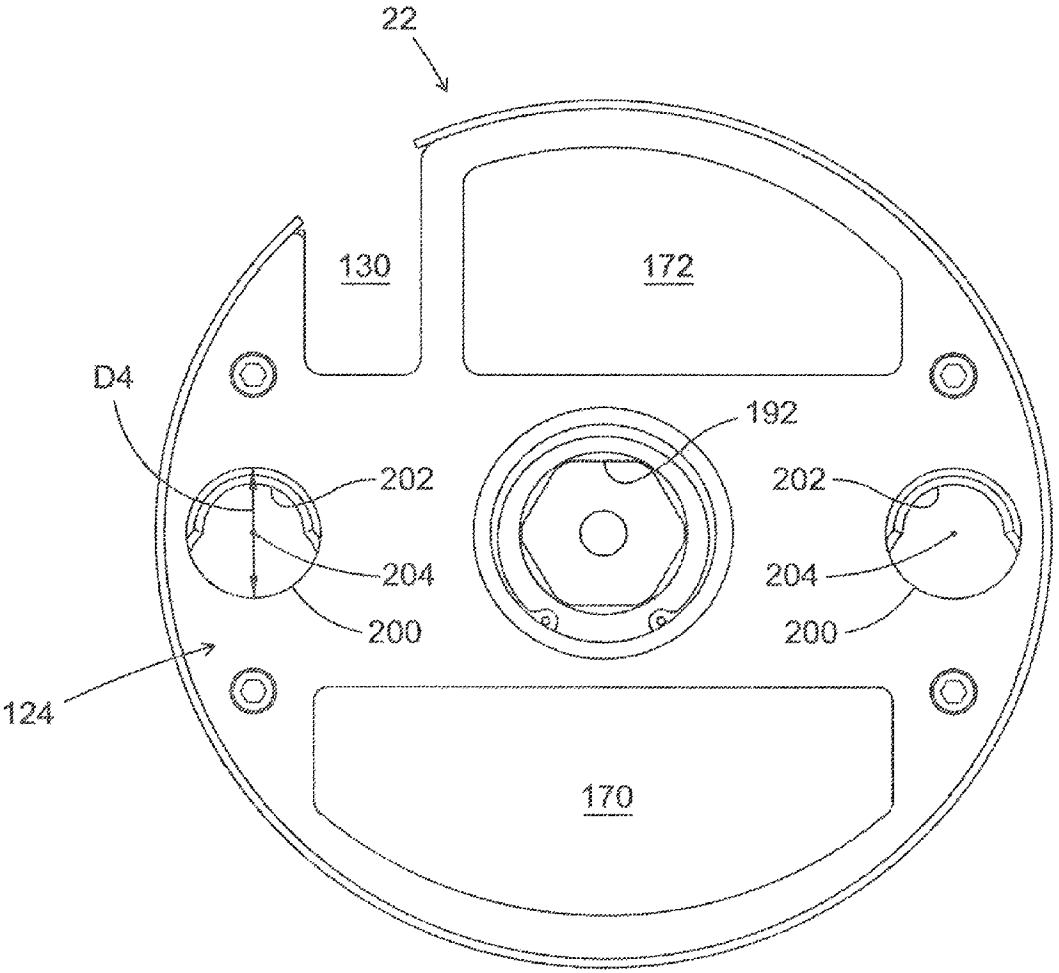
FIG. 7 is an end view showing the female end of the pipe section of FIG. 2.
Figure 8:
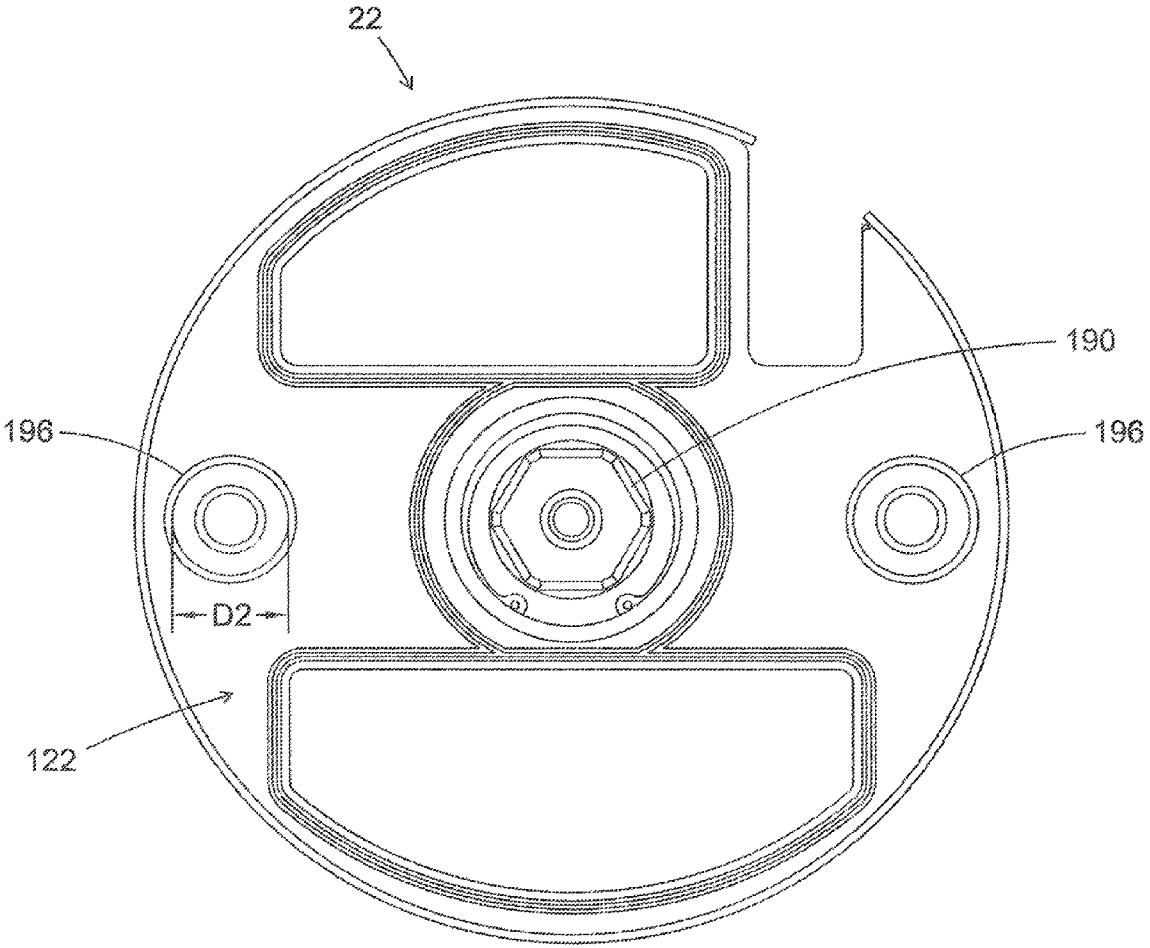
FIG. 8 is an end view showing the male end of the pipe section of FIG. 2.
Figure 9:
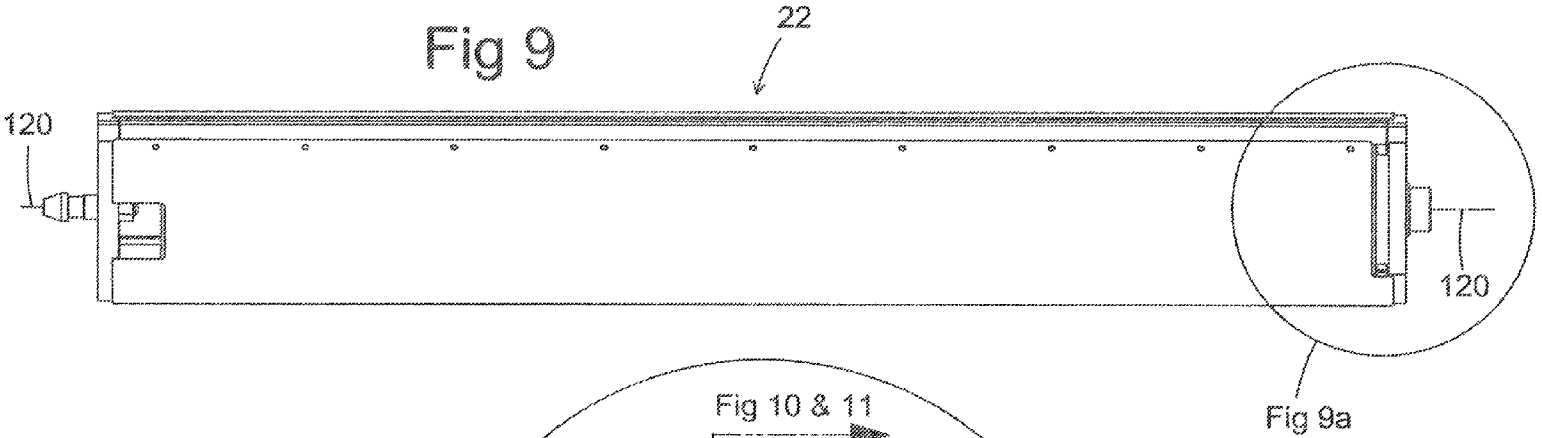
FIG. 9 is a side view of the pipe section of FIG. 2.
Figure 9A:
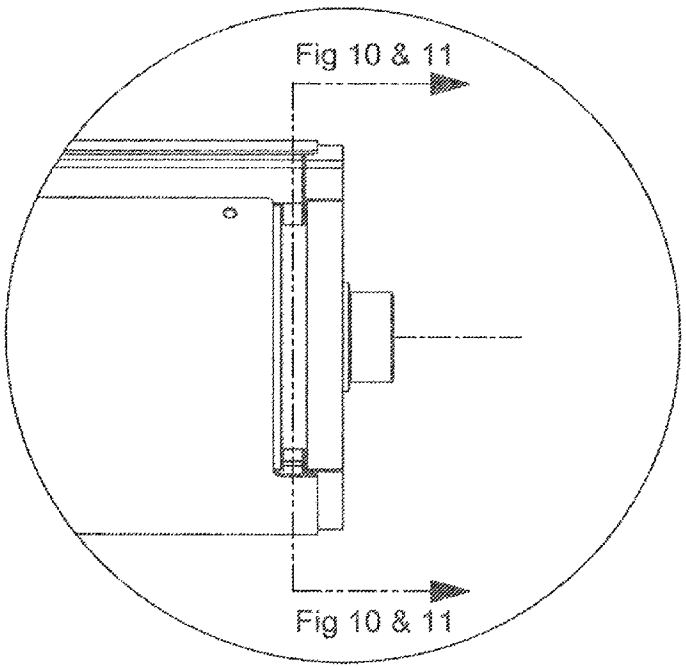
FIG. 9*a* is a detailed view of the female end of the pipe section shown in FIG. 9.

The outer casing assembly 28 of the pipe section 22 also includes structure for rotatably supporting the drive shaft 26 of the pipe section 22. For example, as shown at FIGS. 4-6, the outer casing assembly 28 includes a tubular shaft receiver 140 that extends along the central axis 120 from the male end 122 to the female end 124. Opposite ends of the shaft receiver 140 are secured (e.g., welded) to the end plates 126. The shaft receiver 140 includes a central portion 142 (shown in FIG. 5) and end collars 144. The end collars 144 are secured (e.g., welded) to ends of the central portion 142. The end collars 144 are of larger diameter than the central portion 142. The end collars 144 are also secured (e.g., welded) to the end plates 126 such that the collars 144 function to fix the central portion 142 relative to the end plates 126.

Referring still to FIGS. 4-6, the drive shaft 26 is rotatably mounted within the shaft receiver 140 of the outer casing assembly 28. A bearing 143 (e.g., a radial bushing type bearing as shown at FIG. 6) is preferably provided in at least one of the collars 144 to rotatably support the drive shaft 26 within the shaft receiver 140. In certain embodiments, bearings for supporting the drive shaft 26 can be provided in both of the collars 144 of the shaft receiver 140.

The outer casing assembly 28 also includes a plurality of gusset plates 160 secured between the outer shell 128 and the central portion 142 of the shaft receiver 140 (see FIGS. 4 and 5). The gusset plates 160 assist in reinforcing the outer shell 128 to prevent the outer shell from crushing during handling or other use.

The pipe section 22 also includes a plurality of internal passage sections that extend axially through the pipe section 22 from the male end 122 to the female end 124. For example, referring to FIG. 6, the outer casing assembly 28 defines a first internal passage section 170 and a separate second internal passage section 172. The first and second internal passage sections 170, 172 each extend completely through the length of the pipe section 22. The first internal passage section 170 is defined by a tube structure 173 that extends along the length of the pipe section 22 and has opposite ends secured to the end plates 126. The end plates 126 define openings 175 that align with the tube structure 173. A face seal 177 or other sealing member can be provided at an outer face of at least one of the end plates 126 surrounding the openings 175 such that when two of the pipe sections 22 are latched together, their corresponding passage sections 170 co-axially align and are sealed at the interface between the male and female ends 122, 124 of the latched pipe sections 22. When the pipe sections 22 are latched together to form the drill string 24, the first internal passage sections 170 are co-axially aligned with each other and cooperate to form the continuous vacuum passage 47 that extends axially through the length of the drill string 24.

Referring again to FIG. 6, the second internal passage section 172 is defined by a tube structure 180 having opposite ends secured to the end plates 126. The end plates 126 have openings 181 that align with the tube section 180. A face seal 179 or other sealing member can be provided at an outer face of at least one of the end plates 126 surrounding the openings 181 such that when two of the pipe sections 22 are latched together, their corresponding passage sections 172 co-axially align and are sealed at the interface between the male and female ends 122, 124 of the connected pipe sections 22. When the pipe sections 22 are latched together to form the drill string 24, the second internal passage sections 172 are co-axially aligned with each other and cooperate to form the continuous air passage 43 that extends axially through the length of the drill string 24.

Referring still to FIG. 6, the drive shaft 26 extends through the shaft receiver 140 and includes a male torque transferring feature 190 positioned at the male end 122 of the pipe section 22 and a female torque transferring feature 192 positioned at the female end 124 of the pipe section 22. The male torque transferring feature 190 is formed by a stub (e.g., a driver) that projects outwardly from the end plate 126 at the male end 122 of the pipe section 22. The male torque transferring feature 190 has a plurality of flats (e.g., a hexagonal pattern of flats forming a hex-head) for facilitating transmitting torque from drive shaft to drive shaft when the pipe sections 22 are latched in the drill string 24. The female torque transferring feature 192 of the drive shaft 26 defines a receptacle (e.g., a socket) sized to receive the male torque transferring feature 190 of the drive shaft 26 of an adjacent pipe section 22 within the drill string 24. The female torque transferring feature 192 is depicted as being inset relative to the outer face of the end plate 126 at the female end 124 of the pipe section 22. In one embodiment, the female torque transferring feature 192 has a shape that complements the outer shape of the male torque transferring feature 190. For example, in one embodiment, the female torque transferring feature 192 can take the form of a hex socket. The interface between the male and female torque transferring features 190, 192 allows torque to be transferred from drive shaft to drive shaft of the pipe sections within the drill string 24. The male and female torque transferring features 190, 192 of adjacent pipe sections slide together in a mating relationship when the adjacent pipe sections are axially moved together during assembly of the drill string 24.

As shown at FIG. 6, each of the drive shafts 26 defines a central passage section 194 that extends longitudinally through the drive shaft 26 from the male end 122 to the female end 124. When the pipe sections 22 are latched together to form the drill string 24, the central passage sections 194 of the drive shafts 26 are axially aligned and in fluid communication with one another such that a continuous, uninterrupted central passage (e.g., central passage 45 shown at FIG. 14) extends through the drive shafts 26 of the drill string 24 from the proximal end to the distal end of the drill string 24. The continuous central passage 45 defined within the drive shafts 26 allows drilling fluid to be pumped through the drill string 24 to the cutting unit 34.

The male and female ends 122, 124 of the pipe sections 22 are configured to provide rotational alignment between the pipe sections 22 of the drill string 24. For example, as shown at FIG. 2, the male end 122 includes two alignment projections 196 (e.g., pins) positioned at opposite sides of the central longitudinal axis 120. Referring to FIG. 5, each of the alignment projections 196 includes a base section 197 anchored to the end plate 126 at the male end 122. Each of the alignment projections 196 also includes a main body 195 that projects axially outwardly from the base section 197. The main body 195 includes a head portion 198 with a tapered outer end and a necked-down portion 199 positioned axially between head portion 198 and the base section 197. When a male end 122 of a first pipe section 22 is mated with the female end 124 of a second pipe section 22, the main bodies 195 of the alignment projections 196 provided at the male end 122 fit within (e.g., slide axially into) corresponding projection receptacles 200 (shown at FIG. 3) provided at the female end 124. As the main bodies 195 of the alignment projections 196 slide axially within the projection receptacles 200, slide latches 202 positioned at the female end 124 (see FIG. 10-11) are retained in non-latching positions in which the latches 202 do not interfere with the insertion of the projections 196 through the receptacles 200. The slide latches 202 include openings 206 (shown in FIGS. 10 and 10*a*) corresponding to the projection receptacles 200 at the female end 124. The openings 206 include first regions 208 each having a diameter D1 (see FIGS. 10 and 10*a*) larger than an outer diameter D2 (see FIG. 8) of the head portions 198 and second portions 210 each having a diameter D3 (see FIGS. 10 and 10*a*) that generally matches an outer diameter defined by the necked-down portion 199 of the alignment projections 196. The diameter D3 is smaller than the outer diameter D2 defined by the head portion 198. The projection receptacles 200 have a diameter D4 (see FIG. 7) that is only slightly larger than the diameter D2. When the slide latches 202 are in the non-latching position, the first regions 208 of the openings 206 co-axially align with the projection receptacles 200. After the main bodies of the alignment projections 196 are fully inserted within the projection receptacles 200, a separate latching step is performed in which the latches 202 are moved (e.g., manually with a hammer) to latching positions in which the alignment projections 196 are retained within the projection receptacles 200.

Figure 10:
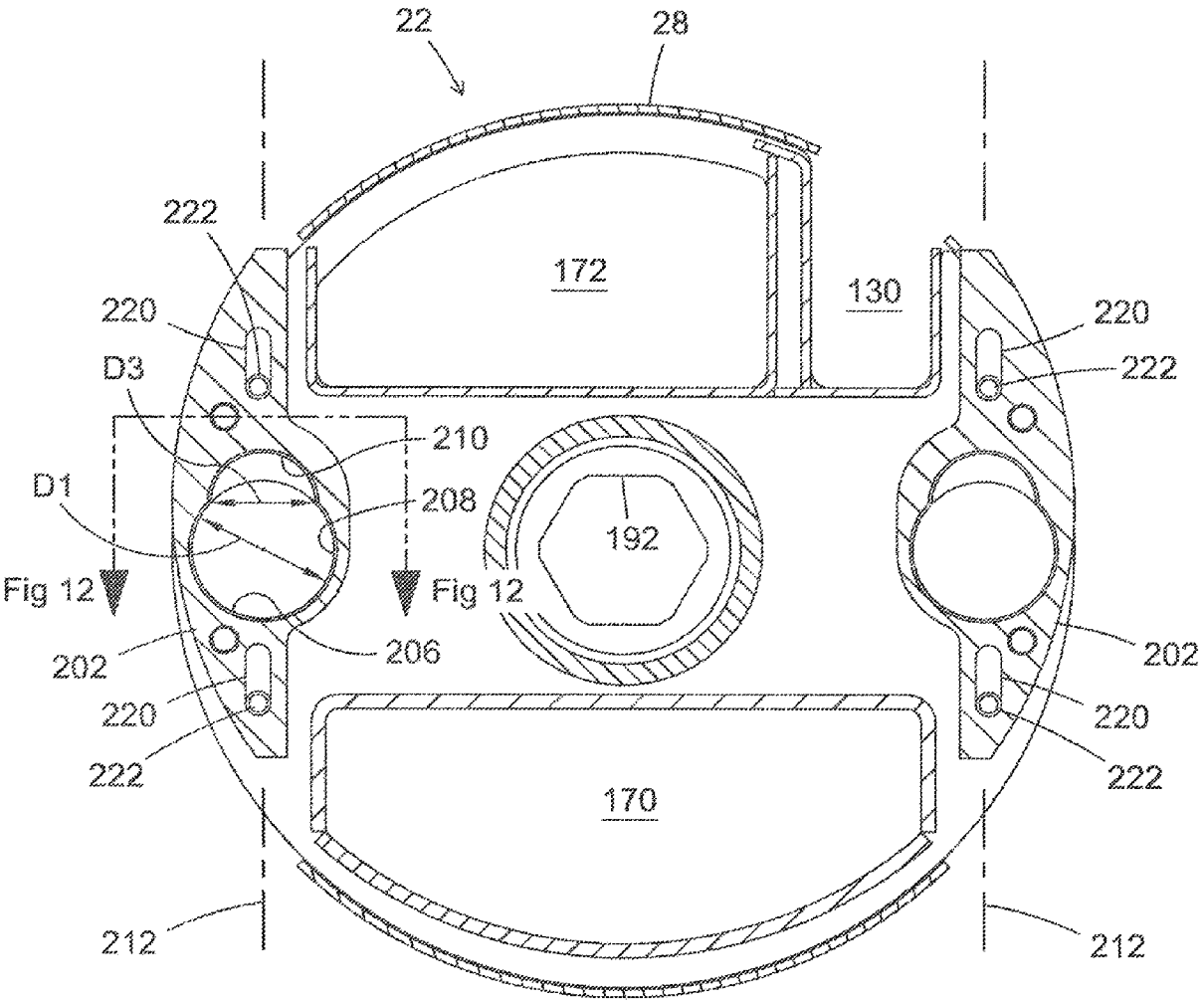
FIG. 10 is a cross-sectional view showing latches mounted at the female end of the pipe section of FIG. 9*a*, the latches are shown in a non-latching position.
Figure 10A:
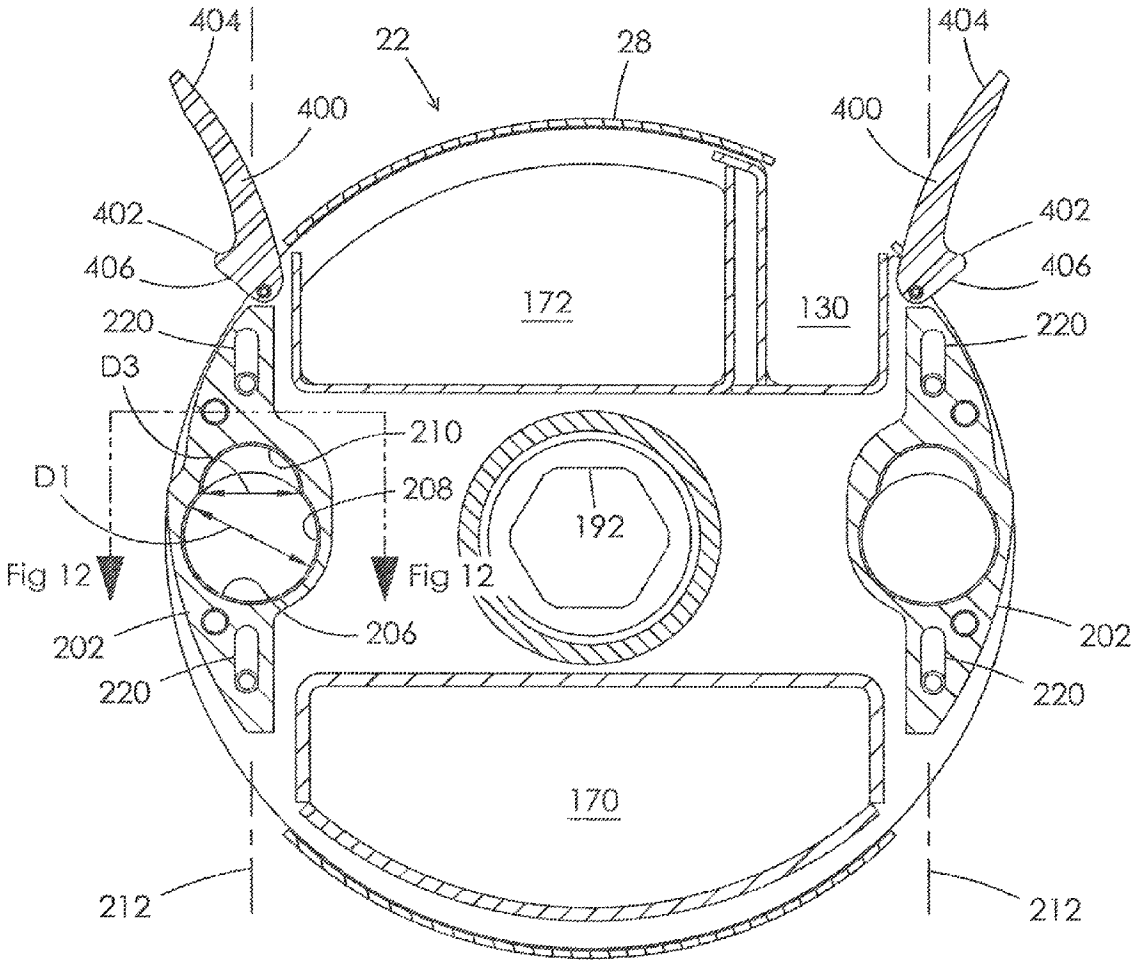
FIG. 10*a* is a cross-sectional view showing the latches of FIG. 10 in a non-latching position and cam arms in a disengaged position.

The slide latches 202 are slideable along slide axes 212 relative to the outer casing 28 of the pipe section 22 between the latching positions (see FIGS. 11, 11*a* and 11*b*) and the non-latching positions (see FIGS. 10 and 10*a*). In non-latching positions, the first regions 208 of the openings 206 of the slide latches 202 coaxially align with the projection receptacles 200. In the latching positions, the first regions 208 of the openings 206 are partially offset from the projections receptacles 200 and the second regions 210 of the openings 206 at least partially overlap the projection receptacles 200.

To latch two pipe sections together, the alignment projections 196 of one of the pipe sections can be inserted into the projection receptacles 200 of the other pipe section. With the slide latches 202 retained in the non-latching positions (i.e., a projection clearance position), the main bodies 195 of the alignment projections 196 can be inserted axially into the projection receptacles 200 and through the first regions 208 of the openings 206 without interference from the slide latches 202. After the alignment projections 196 have been fully inserted into the projection receptacles 200 and relative axial movement between the pipe sections has stopped, the slide latches 202 can be moved to the latching positions. When in the latching positions, the second regions 210 of the openings 206 fit over the necked-down portions 199 of the alignment projections 196 such that portions of the slide latches 202 overlap the head portions 198 of the projections 196. This overlap/interference between the slide latches 202 and the head portions 198 of the alignment projections 196 prevents the main bodies 195 of the alignment projections 196 from being axially withdrawn from the projection receptacles 200. In this way, the latches provide a secure mechanical coupling provided between adjacent individual pipe sections 22 that prevents the pipe sections 22 from being pulled apart and allows pull-back load for backreaming to be axially transferred from pipe section to pipe section. To unlatch the pipe sections 22, the slide latches 202 can be returned to the non-latching position thereby allowing the alignment projections 196 to be readily axially withdrawn from the projection receptacles 200 and allowing the pipe sections 22 to be axially separated from one another.

Figure 11:
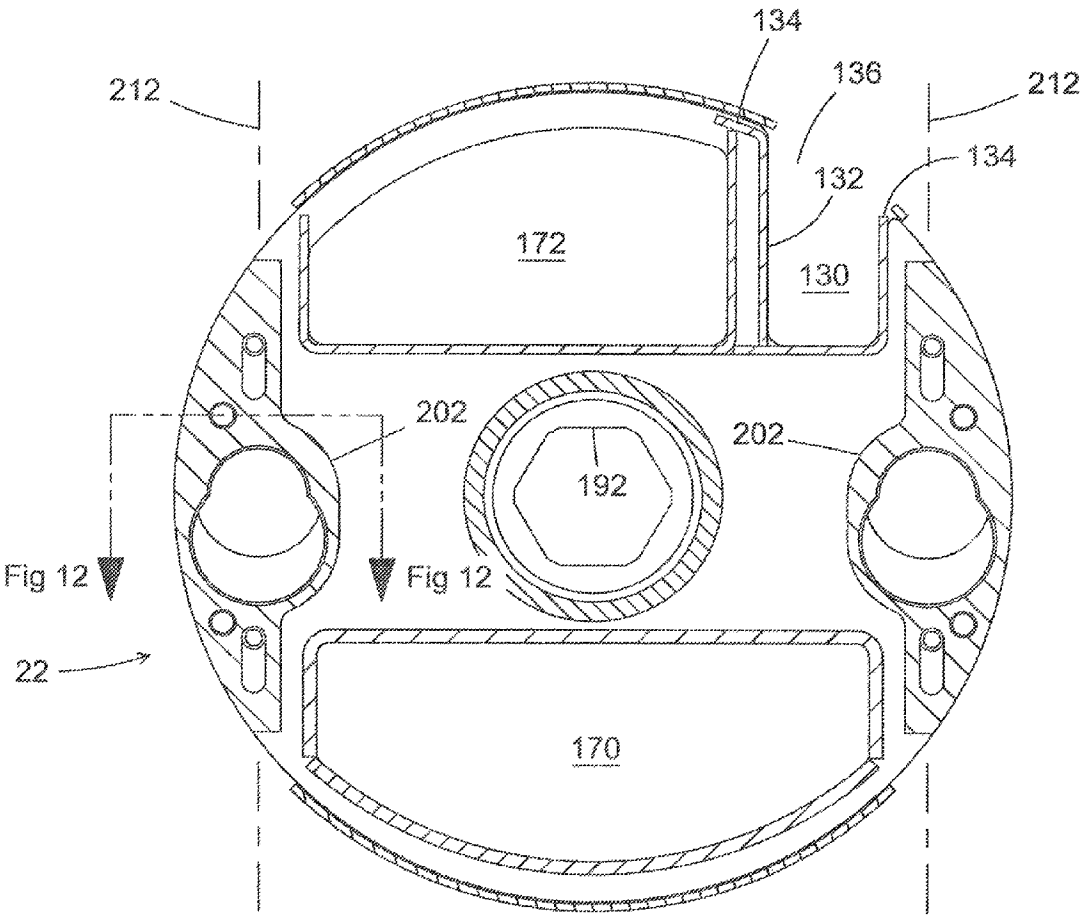
FIG. 11 is a cross-sectional view showing latches mounted at the female end of the pipe section of FIG. 9*a*, the latches are shown in a latching position.
Figure 11A:
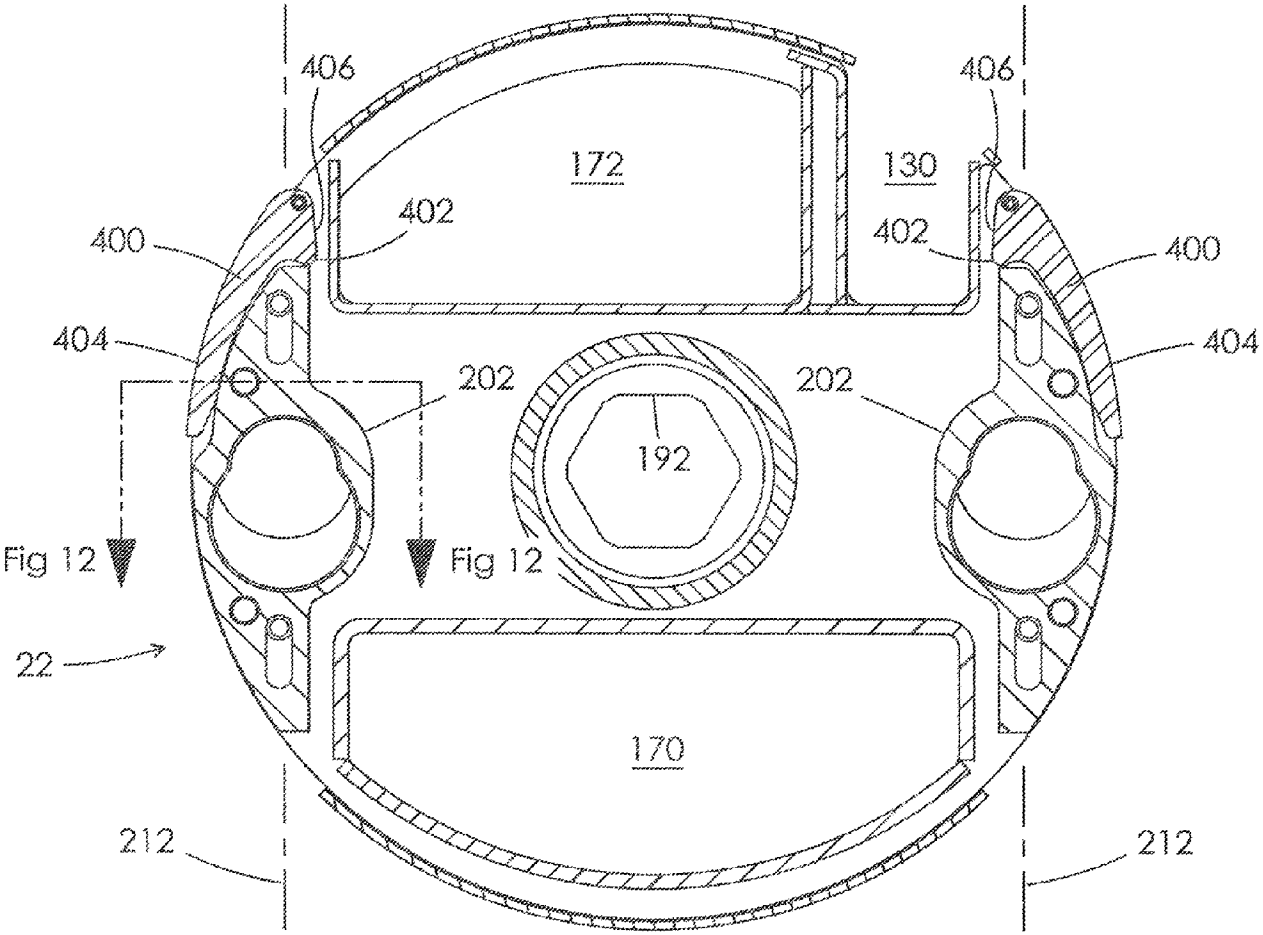
FIG. 11*a* is a cross-sectional view showing the latches of FIG. 11 and the cam arms in an engaged position.
Figure 11B:
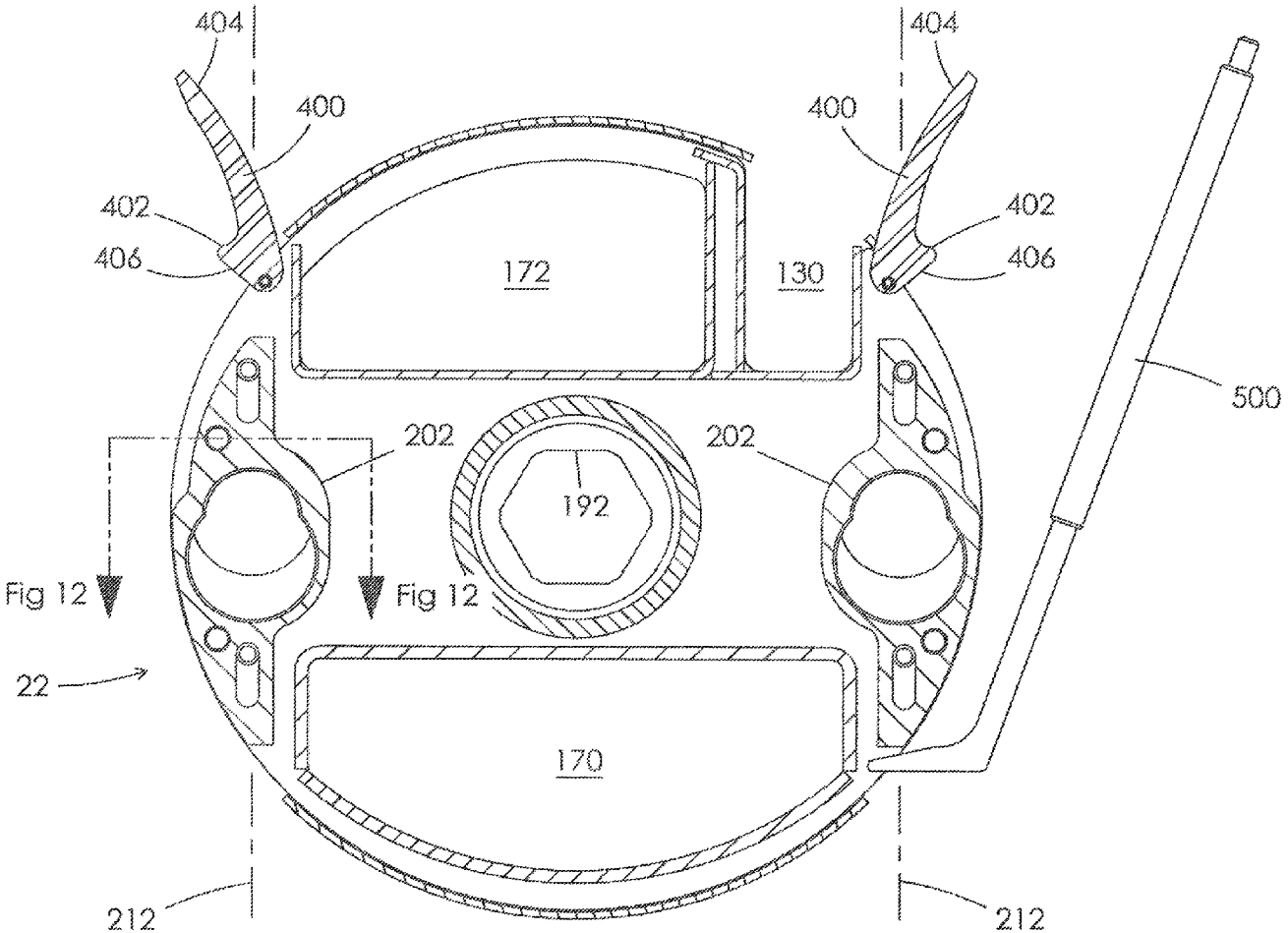
FIG. 11*b* is a cross-sectional view showing the latches of FIG. 11 and the cam arms in a disengaged position.

In some embodiments, the pipe sections include cam arms 400 (shown in FIGS. 10*a*, 11*a* and 11*b*) that move the slide latches 202 into a latching position and retain the slide latches 202 in the latching position. As shown in FIG. 10*a*, the cam arms 400 are in a disengaged position when the slide latches 202 are in a non-latching position. By applying a force on cam arm handles 404 (e.g. manually) the slide latches 202 move into a latching position as shown in FIG. 11*a* when a cam surface 406 of the cam arm 400 presses the slide latch 202 down. The slide latches 202 are then retained in the latching position by a retention member 402 of the cam arm 400 when the cam arm is in an engaged position. When the pipe sections are unlatched, the cam arms 400 are moved to a disengaged position, as shown in FIG. 11*b*, and the slide latches 202 are returned to the non-latching position, e.g. with the aid of a leverage tool such as a crowbar 500, if needed.

The slide axis 212 of each slide latch 202 extends longitudinally through a length of its corresponding slide latch 202. Each slide latch 202 also includes a pair of elongate slots 220 having lengths that extend along the slide axis 212. The outer casing assembly 28 of the pipe section 22 includes pins 222 that extend through the slots 220 of the slide latches 202. The pins 222 prevent the slide latches 202 from disengaging from the outer casing assemblies 28. The slots 220 also provide a range of motion along the slide axes 212 through which the slide latches 202 can slide between the non-latching position and the latching position.

When two of the pipe sections are latched, interference between the slide latches 202 and the enlarged heads/ends 198 of the projections 196 mechanically interlocks or couples the adjacent pipe sections 22 together such that pull-back load or other tensile loads can be transferred from pipe section 22 to pipe section 22 in the drill string 24. This allows the drill string 24 to be withdrawn from a bored hole by pulling the drill string 24 back in a proximal direction. The pull-back load is carried by/through the casing assemblies 28 of the pipe sections 22 and not through the drive shafts 26. Prior to pulling back on the drill string 24, the drill head 30 can be replaced with a back reamer adapted to enlarge the bored hole as the drill string 24 is pulled back out of the bored hole.

The alignment projections 196 and receptacles 200 also maintain co-axial alignment between the pipe sections 22 and ensure that the internal and external axial passage sections defined by each of the pipe sections 24 co-axially align with one another so as to define continuous passageways that extend through the length of the drill string 24. For example, referring to FIG. 9, the alignment provided by the projections 196 and the receptacles 200 ensures that the first internal passage sections 170 of the pipe sections 22 are all co-axially aligned with one another (e.g., all positioned at about the 6 o'clock position relative to the central axis 120), the second internal passages 172 are all co-axially aligned with one another (e.g., all positioned generally at the 12 o'clock position relative to the central axial 120), and the open sided channels 130 are all co-axially aligned with one another (e.g., all positioned generally at the 1 o'clock position relative to the central axis 120).

As indicated above, the end plates 126 of the pipe sections 22 are secured (e.g., welded) to various other components of the outer casing assembly 28. For example, the end plates 126 of a given pipe section 22 can be secured to the outer shell 128, the open-sided passage section 130, the shaft receiver 140, the tube structure 173 and the tube structure 180 of the pipe section 22. The slide latches 202 are mounted between the end plate 126 and a backing plate 370 (shown in FIG. 12). The backing plate 370 is secured (e.g., welded) to the tubular shaft receiver 140, the tube structure 173 and the tube structure 180. The slide latches 202 are slideable up and down along the slide axes 212 relative to the end plate 126 and the backing plate 370. Fasteners are used to retain the slide latches 202 between the end plate 126 and the backing plate 320.

The pipe sections 22 also include retention structures for retaining the slide latches 202 in the non-latching positions. The retaining structures function to prevent the slide latches 202 from unintentionally moving from the non-latching positions to the latching positions. Thus, the retaining structures automatically hold the slide latches 202 in the non-latching positions until an operator intentionally moves the slide latches 202 from the non-latching positions to the latching positions. During a normal drill string assembly routine, the slide latches 202 of a first pipe section are moved to the non-latching positions 202 and retained there by the retention structures. Thereafter, the male end of a second pipe section desired to be latched to the female end of the first pipe section is rotationally aligned with the first pipe section such that the alignment projections 196 coaxially align with the projection receptacles 200. The first and second pipe sections are then slid axially together such that the alignment projections 196 move through the projection receptacles 200 and through the openings 206 of the slide latches 202. Once the first and second pipe sections have been fully slid together with the alignment projections 196 fully inserted within the projection receptacles 200 and relative axial movement between the pipe sections has stopped, the operator can individually manually move each of the slide latches 202 from the non-latching position to the latching position to latch the pipe sections together. To unlatch the pipe sections, the latches are individually moved from the latching position to the non-latching position and then the pipe sections are axially slid apart.

It will be appreciated that the latch retaining structure can include a number of different configurations. For example, the latch retaining structure can include a friction enhancing structure that increases the overall frictional force that must be overcome to move the slide latches 202 from the non-latching position to the latching position. In certain embodiments, the friction enhancing structure can include a biasing structure that applies an axial load between the slide latch 202 and another structure such as the backing plate 370. In certain embodiments, the biasing structure can fit into a detent (e.g., a depression, receiver, receptacle, etc.) when the slide latch 202 is in the non-latching position. In other embodiments, the frictional forces alone effectively retain the slide latch 202 in the non-latching position.

It will be appreciated that in certain embodiments the slide latches 202 can be moved in a plane that is transverse relative to the longitudinal axes of the pipe sections being latched together (e.g., the slide axes 212 of the latches are positioned in such transverse planes). Also, the latch retaining structure can generate a retention force (i.e., an axial load) that is applied to the latch in a direction parallel to the longitudinal axes of the pipe sections being latched together. In other embodiments, the latch retaining structure may apply a retention force to the latch in a direction angled relative to the longitudinal axes of the pipe sections being latched together such that the axial load applied to the latch is provided by a vector component of the retention force. In either case, an axial load is applied to the latch in a direction transverse to the direction of movement of the latch along the slide axis 212 to thereby assist in frictionally retaining the latch in the non-latching position.

Figure 12:
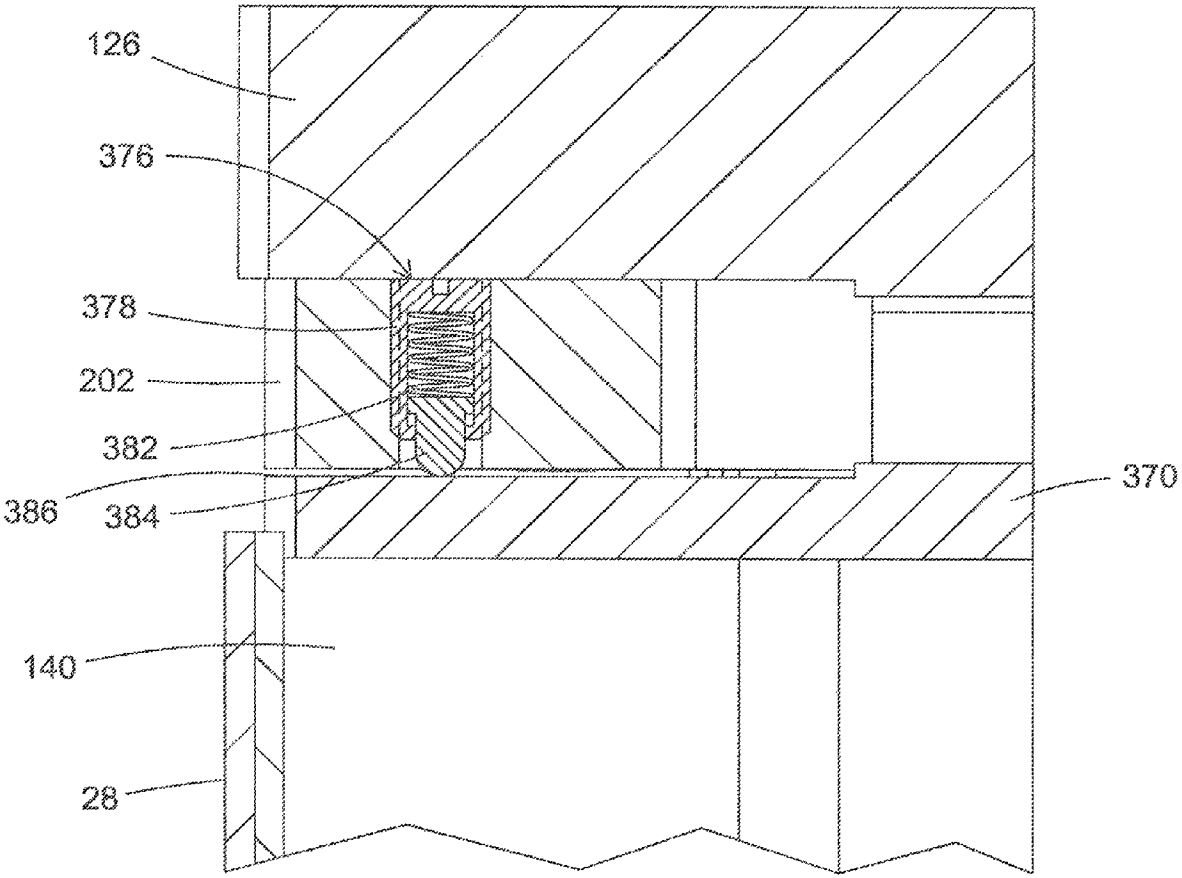
FIG. 12 is a partial cross-sectional perspective view of the female end of one of the pipe sections of the drilling/tunneling apparatus of FIG. 1, friction enhancing structures are shown.

FIG. 12 shows an example latch retaining structure 376. The latch retaining structure 376 is carried by the slide latch 202. For example, the latch retaining structure 376 is shown mounted within an axially extending opening 378 defined through the slide latch 202. The opening 378 is internally threaded. The slide latch retaining structure 376 includes an outer housing that is externally threaded and that threads into the axial opening 378. A spring 382 and a plunger 384 are at least partially mounted within the housing. The spring 382 biases the plunger 384 against a face 386 of the backing plate 370. In this way, the latch retaining structure 376 applies a continuous axial load between the slide latch 202 and the backing plate 370. This spring biased axial load generates an increased normal force between the plunger and the backing plate 370 and between the slide latch 202 and the end plate 126. This spring generated normal force enhances friction between the slide latch 202 and the end plate 126 and/or the backing plate 370. This enhanced friction assists in retaining the slide latch 202 in the non-latching position. By removing the slide latches 202 as described above, the latch retaining structures 376 can readily be accessed for replacement or repair as needed.

C. Example Drive Unit

Figure 13:
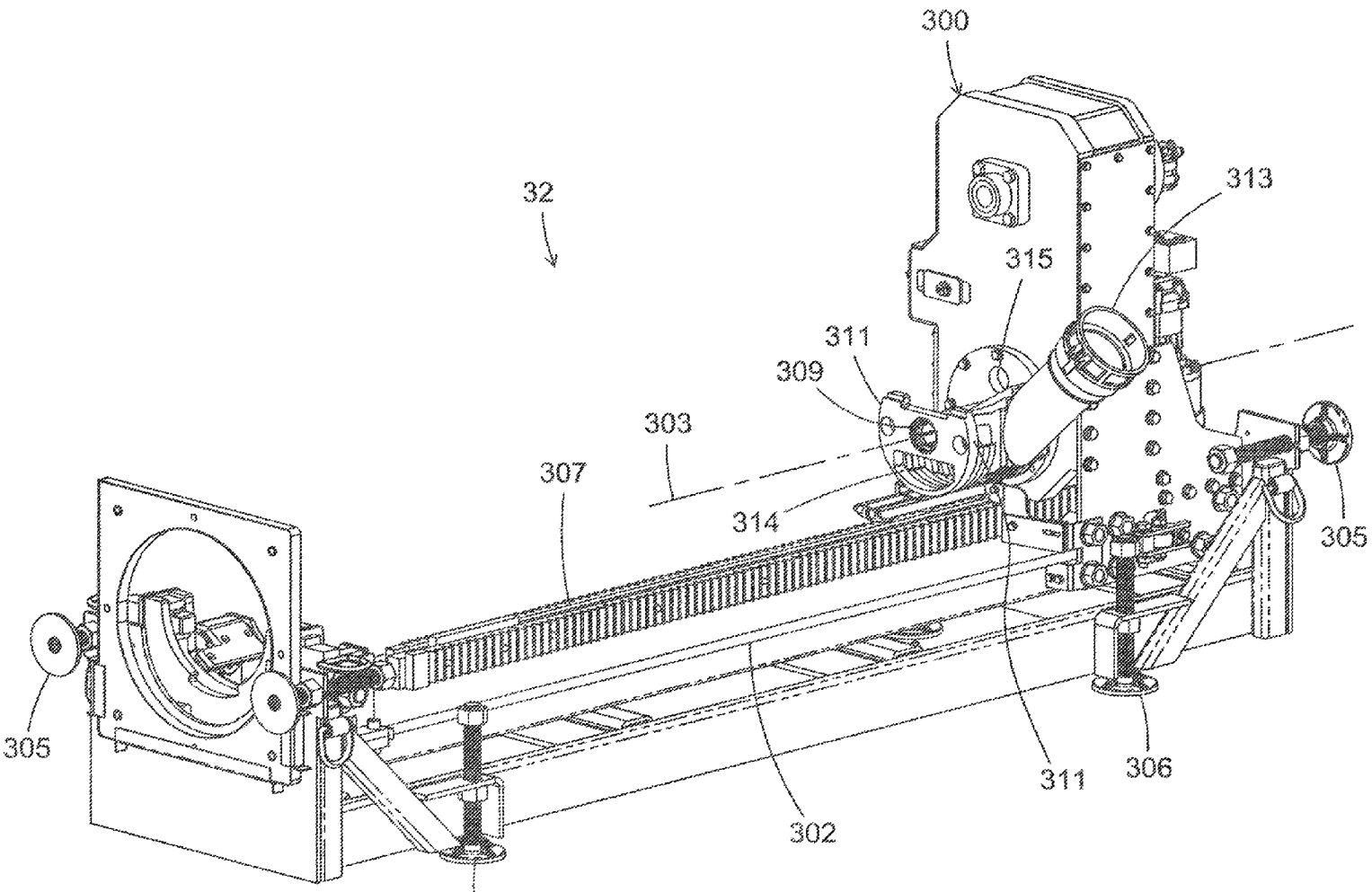
FIG. 13 shows an example drive unit suitable for use with the tunneling apparatus schematically depicted at FIG. 1.

FIG. 13 shows an example configuration for the drive unit 32 of the tunneling/drilling apparatus 20. Generally, the drive unit 32 includes a carriage 300 that slidably mounts on a track structure 302. The track structure 302 is supported by a base of the drive unit 32 adapted to be mounted within an excavated structure such as a pit. Extendable feet 305 can be used to anchor the tracks within the pit and extendable feet 306 can be used to set the base at a desired angle relative to horizontal. The drive unit 32 includes a thrust driver for moving the carriage 300 proximally and distally along an axis 303 parallel to the track structure 302. The thrust driver can include a hydraulically powered pinion gear arrangement (e.g., one or more pinion gears driven by one or more hydraulic motors) carried by the carriage 300 that engages an elongated gear rack 307 that extends along the track structure 302. In other embodiments, hydraulic cylinders or other structures suitable for moving the carriage distally and proximally along the track can be used. The drive unit 32 also includes a torque driver (e.g., a hydraulic drive) carried by the carriage 300 for applying torque to the drill string 24. For example, as shown at FIG. 13, the drive unit can include a female rotational drive element 309 mounted on the carriage 300 that is selectively driven/rotated in clockwise and counter clockwise directions about the axis 303 by a drive (e.g., hydraulic drive motor) carried by the carriage 300. The female rotational drive element 309 can be adapted to receive the male torque transferring feature 190 of the drive shaft 26 corresponding to the proximal-most pipe section of the drill string 24. Projection receptacles 311 are positioned on opposite sides of the female drive element 309. The projection receptacles 311 are configured to receive the projections 196 of the proximal-most pipe section 22 to ensure that the proximal-most pipe section 22 is oriented at the proper rotational/angular orientation about the central axis 303 of the drill string.

The carriage also carries a vacuum hose port 313 adapted for connection to a vacuum hose that is in fluid communication with the vacuum 65 of the tunneling apparatus 20. The vacuum hose port 313 is also in fluid communication with a vacuum port 314 positioned directly beneath the female drive element 309. The vacuum port 314 co-axially aligns with the first internal passage section 170 of the proximal-most pipe section 22 when the proximal-most pipe section is latched to the drive unit 32. In this way, the vacuum 65 is placed in fluid communication with the vacuum passage 47 of the drill string 24 so that vacuum can be applied to the vacuum passage 47 to draw slurry through the vacuum passage 47.

The carriage 300 also defines a laser opening 315 through which the laser beam 42 from the laser 40 can be directed. The laser beam opening 315 co-axially aligns with the second internal passage section 172 of the proximal-most pipe section 22 when the proximal-most pipe section 22 is latched to the drive unit 32. In this way, the laser beam 42 can be sent through the air passage 43 of the drill string 24.

The female rotational drive element 309 also defines a central opening in fluid communication with a source of drilling fluid (e.g., the fluid/liquid pump 63 of the tunneling apparatus 20). When the female rotational drive element 309 is mated to the male torque transferring feature 190 of the drive shaft 26 of the proximal-most pipe section, drilling fluid can be introduced from the source of drilling fluid through the male torque transferring feature 190 to the central fluid passage (e.g., passage 45) defined by the drive shafts 26 of the pipe sections 22 of the drill string 24. The central fluid passage defined by the drive shafts 26 carries the drilling fluid from the proximal end to the distal end of the drill string 24 such that drilling fluid is provided at the cutting face of the cutting unit 34.

To drill a bore, a pipe section 22 with the drill head 30 mounted thereon is loaded onto the drive unit 32 while the carriage is at a proximal-most position of the track structure 302. The proximal end of the pipe section 22 is then latched to the carriage 300. Next, the thrust driver propels the carriage 300 in a distal direction along the axis 303 while torque is simultaneously applied to the drive shaft 26 of the pipe section 22 by the female rotational drive element 309. By using the thrust driver to drive the carriage 300 in the distal direction along the axis 303, thrust is transferred from the carriage 300 to the outer casings 28 of the pipe section 22 thereby causing the pipe section 22 to be pushed distally into the ground. Once the carriage 300 reaches the distal-most position of the track structure 302, the proximal end of the pipe section 22 is unlatched from the carriage 300 and the carriage 300 is returned back to the proximal-most position. The next pipe section 22 is then loaded into the drive unit 32 by latching the distal end of the new pipe section 22 to the proximal end of the pipe section 22 already in the ground and also latching the proximal end of the new pipe section 22 to the carriage 300. The carriage 300 is then propelled again in the distal direction while torque is simultaneously applied to the drive shaft 26 of the new pipe section 22 until the carriage 300 reaches the distal-most position. Thereafter, the process is repeated until the desired number of pipe sections 22 have been added to the drill string 24.

The drive unit 32 can also be used to withdraw the drill string 24 from the ground. By latching the projections 196 of the proximal-most pipe section 22 within the projection receptacles 311 of the drive unit carriage 300 (e.g., with slide latches provided on the carriage) while the carriage 300 is in the distal-most position, and then using the thrust driver of the drive unit 32 to move the carriage 300 in the proximal direction from the distal-most position to the proximal-most position, a pull-back load is applied to the drill string 24 which causes the drill string 24 to be withdrawn from the drilled bore in the ground. If it is desired to back ream the bore during the withdrawal of the drill string 24, the cutting unit 34 can be replaced with a back reamer that is rotationally driven by the torque driver of the drive unit 32 as the drill string 24 is pulled back. After the proximal-most pipe section 22 has been withdrawn from the bore and unlatched from the drive unit 32, the carriage 300 can be moved from the proximal-most position to the distal-most position and latched to the proximal-most pipe section still remaining in the ground. Thereafter, the retraction process can be repeated until all of the pipe sections have been pulled from the ground.

From the foregoing detailed description, it will be evident that modifications and variations can be made in the devices of the disclosure without departing from the spirit or scope of the invention.

What is claimed is:

1. A drill rod comprising:

a casing assembly defining a length that extends axially between a first end and an opposite second end of the drill rod, the casing assembly defining a first passage that extends axially along the drill rod from the first end of the casing assembly to the second end of the casing assembly, the casing assembly also defining a second passage that extends axially along the drill rod from the first end of the casing assembly to the second end of the casing assembly;

a drive shaft rotatably mounted within the casing assembly, the drive shaft extending axially along the drill rod generally from the first end of the casing assembly to the second end of the casing assembly, the drive shaft having a center axis that is offset from axes of the first and second passages, the axes of the first and second passages also being offset from one another;

the casing assembly further includes first and second end plates positioned respectively at the first and second ends of the casing assembly, the first and second end plates supporting the drive shaft, the first and second end plates also defining first openings that align with the first passage and second openings that align with the second passage;

the casing assembly includes an outer shell that defines an outer boundary of the drill rod and that extends from the first end plate to the second end plate;

the drill rod also including alignment pins that project outwardly from the first end plate and alignment pin receivers defined by the second end plate;

the drill rod further including latches mounted between the second end plate and a backing plate adjacent the alignment pin receivers for latching alignment pins of an adjacent drill rod within the alignment pin receivers, the latches being movable between latching and non-latching positions, the latches moving in a plane that is generally transverse relative to the center axis of the drive shaft when the latches move between the latching and non-latching positions; and the drill rod including biasing structures that apply retention forces to the latches for retaining the latches in the non-latching position, the retention forces having at least components that extend along the center axis of the drive shaft, wherein the biasing structures include springs carried by the latches as the latches move between the latching and non-latching positions that cause the retention forces to be applied between the latches and the backing plate, and wherein the spring biases a plunger against the backing plate.

2. The drill rod of claim 1, wherein the latches define slots that are elongated along a direction of movement of the latches, and wherein the drill rod includes pins that extend into the slots and are secured to the second end plate.

3. The drill rod of claim 1, wherein the retention forces cause the latches to be frictionally retained in the non-latching positions.

4. The drill rod of claim 1, further comprising cam arms for retaining the latches in the latching position.

5. A pipe section comprising:

a casing assembly defining a length that extends axially between a first end and an opposite second end of the pipe section;

latching pins at the first end of the pipe section and latching pin receivers at the second end of the pipe section;

latches provided adjacent the latching pin receivers, the latches being movable between latching and non-latching positions; and retention members provided adjacent the latches, each retention member being movable between an engaged position where the latch is retained in the latching position and a disengaged position where the latch is movable between the latching position the non-latching position.

6. The pipe section of claim 5, wherein the latches and the retention members are movable along an orientation of movement that is aligned along a plate that is perpendicular to a central longitudinal axis of the pipe section.

7. The pipe section of claim 5, further comprising a drive shaft rotatably mounted within the casing assembly, the drive shaft extending axially along the pipe section generally from the first end of the casing assembly to the second end of the casing assembly.

8. The pipe section of claim 7, wherein the retention members are pivotal about an axis generally parallel to the drive shaft.

9. The pipe section of claim 5, wherein the retention members include cam arms for moving the latches from the non-latching position to the latching position.

10. The pipe section of claim 5, wherein the retention members are pivotally movable from the disengaged position to the engaged position to retain the latches in the latching position.

11. The pipe section of claim 5, further comprising:

biasing structures that apply retention forces to the latches for retaining the latches in the non-latching position, the retention forces having at least components that extend in directions perpendicular to the orientation of movement of the latches.

12. The pipe section of claim 5, wherein the casing assembly further includes an end plate and a backing plate, and wherein the latches and the retention members are movably mounted between the end plate and the backing plate.

13. A pipe section comprising:

a casing assembly defining a length that extends axially between a first end and an opposite second end of the pipe section;

latching pins at the first end of the pipe section and latching pin receivers at the second end of the pipe section;

latches provided adjacent the latching pin receivers, the latches being movable between latching and non-latching positions; and retention members that selectively apply retention forces to the latches for retaining the latches in the latching position, each retention member being movable between an engaged position where the latch is retained in the latching position and a disengaged position where the latch is movable between the latching position the non-latching position.

14. The pipe section of claim 13, wherein the retention members include arms that move the latches from the non-latching position to the latching position.

15. The pipe section of claim 13, wherein the retention members are pivotally movable between the engaged position and disengaged position.

16. The pipe section of claim 15, further comprising:

a drive shaft rotatably mounted within the casing assembly, the drive shaft extending axially generally from a first end of the casing assembly to a second end of the casing assembly;

wherein the retention members pivot about an axis that extends generally parallel the drive shaft.

17. The pipe section of claim 13, wherein the casing assembly further includes an end plate and a backing plate, and wherein the latches and the retention members are mounted between the end plate and the backing plate.

18. The pipe section of claim 13, wherein the latches and the retention members are generally situated on a common plane.

* * * * *